US008955476B2

(12) United States Patent
Sunada et al.

(10) Patent No.: US 8,955,476 B2
(45) **Date of Patent: *Feb. 17, 2015**

(54) VARIABLE VALVE OPERATING APPARATUS FOR INTERNAL COMBUSTION ENGINE

(75) Inventors: Hirotaka Sunada, Nagoya (JP); Motohiro Tsuzuki, Nisshin (JP); Woongseon Ryu, Toyota (JP); Akihiko Kawata, Susono (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 189 days.

This patent is subject to a terminal disclaimer.

(21) Appl. No.: 13/500,671

(22) PCT Filed: Nov. 25, 2009

(86) PCT No.: PCT/JP2009/069876

§ 371 (c)(1),
(2), (4) Date: Apr. 6, 2012

(87) PCT Pub. No.: WO2011/064852

PCT Pub. Date: Jun. 3, 2011

(65) Prior Publication Data

US 2012/0222635 A1 Sep. 6, 2012

(51) Int. Cl.
*F01L 1/34* (2006.01)
*F01L 13/00* (2006.01)
(Continued)

(52) U.S. Cl.
CPC ..... *F01L 13/0005* (2013.01); *F01L 1/267* (2013.01); *F01L 1/185* (2013.01); *F01L 1/2405* (2013.01);
(Continued)

(58) Field of Classification Search
USPC ..... 123/90.15–90.18
See application file for complete search history.

(56) References Cited

U.S. PATENT DOCUMENTS 2,843,095 A * 7/1958 Prentice ..... 123/90.2
5,353,756 A 10/1994 Murata et al.
(Continued)

FOREIGN PATENT DOCUMENTS

DE 42 30 877 4/1993
DE 199 45 340 A1 3/2001
(Continued)

OTHER PUBLICATIONS

International Search Report Issued Dec. 22, 2009 in PCT/JP09/69876 Filed Nov. 25, 2009.
(Continued)

*Primary Examiner* — Thomas Denion
*Assistant Examiner* — Steven D Shipe
(74) *Attorney, Agent, or Firm* — Oblon, Spivak, McClelland, Maier & Neustadt, L.L.P.

(57) ABSTRACT

A variable valve operating apparatus for an internal combustion engine is provided which includes a helical wall part provided in a guide rail for changing valve opening characteristics of a valve and a projection part, and can secure a contact area between the two when the two are engaged, thus successfully reducing the contact pressure generated between the two. The placement of the projection part with respect to the helical wall part is determined such that the central axis line of the projection part and the central axis line of a camshaft perpendicularly intersect with each other in a state in which the projection part is protruded toward the guide rail by an actuator.

3 Claims, 18 Drawing Sheets

(51) Int. Cl.
*F01L 1/26* (2006.01)
*F01L 1/18* (2006.01)
*F01L 1/24* (2006.01)

(52) U.S. Cl.
CPC ..... *F01L 2013/0052* (2013.01); *F01L 2105/00* (2013.01); *F01L 2250/02* (2013.01); *F01L 2250/04* (2013.01); *F01L 2820/031* (2013.01)
USPC ..... 123/90.16

(56) References Cited

U.S. PATENT DOCUMENTS

| | | | | |
|---|---|---|---|---|
| 5,785,017 | A | 7/1998 | Saito et al. | |
| 5,809,953 | A | 9/1998 | Saito et al. | |
| 6,467,444 | B2 | 10/2002 | Tanaka et al. | |
| 6,915,768 | B2 | 7/2005 | Ohsawa | |
| 7,415,954 | B2 | 8/2008 | Falkowski et al. | |
| 8,166,941 | B2 * | 5/2012 | Werler | 123/90.48 |
| 8,186,318 | B2 * | 5/2012 | Sunada et al. | 123/90.16 |
| 8,191,520 | B2 * | 6/2012 | Kidooka et al. | 123/90.16 |
| 8,230,833 | B2 | 7/2012 | Werler et al. | |
| 8,251,028 | B2 * | 8/2012 | Ezaki et al. | 123/90.16 |
| 8,286,600 | B2 | 10/2012 | Riley et al. | |
| 8,443,588 | B2 | 5/2013 | Nishikiori et al. | |
| 8,468,988 | B2 | 6/2013 | Nishikiori et al. | |
| 8,622,035 | B2 * | 1/2014 | Meintschel et al. | 123/90.11 |
| 2005/0011480 | A1 | 1/2005 | Schultz et al. | |
| 2006/0283412 | A1 | 12/2006 | Tsuruta et al. | |
| 2007/0034184 | A1 | 2/2007 | Dengler | |
| 2009/0025666 | A1 | 1/2009 | Tateno et al. | |
| 2009/0277407 | A1 | 11/2009 | Ezaki | |
| 2010/0126447 | A1 * | 5/2010 | Talan et al. | 123/90.17 |
| 2010/0139594 | A1 | 6/2010 | Wutzler et al. | |
| 2011/0079191 | A1 | 4/2011 | Lengfeld et al. | |
| 2011/0088642 | A1 | 4/2011 | Ezaki | |
| 2011/0126786 | A1 | 6/2011 | Kidooka et al. | |
| 2011/0214636 | A1 | 9/2011 | Sunada et al. | |
| 2011/0271917 | A1 | 11/2011 | Ezaki et al. | |
| 2012/0055428 | A1 * | 3/2012 | Kidooka | 123/90.16 |
| 2012/0138001 | A1 | 6/2012 | Werler et al. | |
| 2012/0138002 | A1 * | 6/2012 | Tsuzuki et al. | 123/90.18 |

FOREIGN PATENT DOCUMENTS

| | | | |
|---|---|---|---|
| DE | 102 41 920 | A1 | 3/2004 |
| EP | 0 519 494 | A1 | 12/1992 |
| EP | 0 628 703 | A1 | 12/1994 |
| JP | 61-93217 | | 5/1986 |
| JP | 62-184118 | | 11/1987 |
| JP | 2-11812 | | 1/1990 |
| JP | 2-95710 | | 4/1990 |
| JP | 6-33714 | | 2/1994 |
| JP | 6-212924 | | 8/1994 |
| JP | 7-23558 | | 5/1995 |
| JP | 8-312318 | | 11/1996 |
| JP | 8 338213 | | 12/1996 |
| JP | 10 8928 | | 1/1998 |
| JP | 10-196334 | | 7/1998 |
| JP | 11-235000 | | 8/1999 |
| JP | 2000-8819 | | 1/2000 |
| JP | 2003-120375 | | 4/2003 |
| JP | 2003-293714 | | 10/2003 |
| JP | 2004-124794 | | 4/2004 |
| JP | 2005-42717 | | 2/2005 |
| JP | 2006-242013 | | 9/2006 |
| JP | 2006-242018 | | 9/2006 |
| JP | 2006 520869 | | 9/2006 |
| JP | 2006-307712 | | 11/2006 |
| JP | 2006-316664 | | 11/2006 |
| JP | 2008-196462 | | 8/2008 |
| JP | 2008-267328 | | 11/2008 |
| JP | 2009-180142 | | 8/2009 |
| JP | 2009 228543 | | 10/2009 |
| JP | 2009-293613 | | 12/2009 |
| JP | 2010-096142 | | 4/2010 |
| JP | 2010-275935 | | 12/2010 |
| WO | 2009 136551 | | 11/2009 |

OTHER PUBLICATIONS

U.S. Office Action mailed in U.S Appl. No. 13/389,540 on Aug. 29, 2013.
U.S. Office Action mailed in U.S Appl. No. 13/389,540 on Dec. 19, 2013.
U.S. Office Action mailed in U.S Appl. No. 13/389,540 on Mar. 21, 2014.
U.S. Notice of Allowance mailed in U.S Appl. No. 12/677,622 on Jun. 7, 2012.
U.S. Notice of Allowance mailed in U.S Appl. No. 12/677,447 on Mar. 30, 2012.
U.S. Notice of Allowance mailed in U.S. Appl. No. 12/676,830 on Mar. 9, 2012.
U.S. Notice of Allowance mailed in U.S. Appl. No. 13/318,870 on Dec. 20, 2013.
Office Action received in corresponding German Application No. 11 2009 005 395.5 dated Dec. 2, 2013.

* cited by examiner (A)

(B)

VARIABLE VALVE OPERATING APPARATUS FOR INTERNAL COMBUSTION ENGINE

TECHNICAL FIELD

The present invention relates to a variable valve operating apparatus for an internal combustion engine.

BACKGROUND ART

Conventionally, for example, Patent Document 1 discloses a valve operating mechanism for an internal combustion engine, which is provided with a cam carrier for each cylinder, the cam carrier being provided with two kinds of cams, and changes over a valve driving cam for each cylinder by moving the cam carrier in the axial direction with respect to the cam main axis which is driven to rotate. To be more specific, this conventional valve operating mechanism is provided with a guide groove which is formed into a helical shape on opposite ends on the outer peripheral surface of each cam carrier. Moreover, an electric actuator is provided for each guide groove for driving a drive pin which is inserted into or withdrawn from the guide groove.

According to the above described conventional valve operating mechanism, the cam carrier is displaced in its axial direction by the engagement of the drive pin with a guide groove. Since this changes over the valve driving cam of each cylinder, it is possible to change the lift amount of the valve.

It is noted that the applicant recognizes the following documents including the above described one as those relating to the present invention.

CITATION LIST

Patent Documents

Patent Document 1: Japanese National Publication of International Application No. 2006-520869

Patent Document 2: Japanese Laid-open Patent Application Publication No. 1996-338213

SUMMARY OF INVENTION

Technical Problem

In a variable valve operating apparatus in which valve opening characteristics are changed over in association with the relative displacement that takes place during the engagement of a helical wall part (guide groove) provided in a guide rail and a projection part (drive pin) as in the above described conventional variable valve operating apparatus, a small contact area between the helical wall part and the projection part increases the contact pressure (contact load/contact area) generated between the two. As a result, there is a concern that the wear in the helical wall part or the projection part may increase.

The present invention has been made to solve the above described problem, and has an object to provide a variable valve operating apparatus for an internal combustion engine which, when a helical wall part provided in a guide rail and a projection part are engaged with each other to change the valve opening characteristics of the vale, can secure a contact area between the two, thereby successfully reducing a contact pressure generated between the two.

Solution to Problem

A first aspect of the present invention is a variable valve operating apparatus for an internal combustion engine, comprising:

a variable mechanism which is placed between a cam and a valve, and changes valve opening characteristics of the valve; and a changeover mechanism which changes over operational states of the variable mechanism, wherein the changeover mechanism includes:

a guide rail which is provided in an outer peripheral surface of a camshaft including the cam, and is provided with a helical wall part;

a projection part which is disengageably placed in the helical wall part; and an actuator which is capable of protruding the projection part toward the guide rail such that the projection part is engaged with the helical wall part, wherein the changeover mechanism is adapted to change over operation states of the variable mechanism in association with a relative displacement between the projection part and the helical wall part that takes place during engagement between the projection part and the helical wall part, and wherein a placement of the projection part with respect to the helical wall part is determined such that a central axis line of the projection part and a central axis line of the camshaft perpendicularly intersect with each other in a state in which the projection part is protruded toward the guide rail by the actuator.

A second aspect of the present invention is the variable valve operating apparatus for an internal combustion engine according to the first aspect of the present invention, wherein the projection part is formed such that a width of its distal end part is smaller than that of its base end part, and a width of its intermediate part is not larger than that of the based end part, when viewed from an axial direction of the camshaft.

A third aspect of the present invention is the variable valve operating apparatus for an internal combustion engine according to the second aspect of the present invention, wherein the projection part is formed so as to be narrowed down toward a shaft center of the camshaft when viewed from the axial direction of the camshaft in the state of being protruded toward the guide rail by the actuator.

A fourth aspect of the present invention is the variable valve operating apparatus for an internal combustion engine according to the third aspect of the present invention, wherein the projection part is tapered to be thinner toward a distal end side when viewed from the axial direction of the camshaft.

A fifth aspect of the present invention is the variable valve operating apparatus for an internal combustion engine according to the fourth aspect of the present invention, wherein a guide surface that guides the distal end part of the projection part which is inserted to the helical wall part is formed in at least one of the distal end part of the projection part and an upper part of the helical wall part.

A sixth aspect of the present invention is the variable valve operating apparatus for an internal combustion engine according to the fifth aspect of the present invention, wherein the guide surface is a surface inclined downward of the helical wall part when viewing the distal end part of the projection part and the upper part of the helical wall part from a normal line direction of a virtual plane including an intersection between the central axis line of the projection part and the central axis line of the camshaft in the state of being protruded toward the guide rail by the actuator.

Advantageous Effects of Invention

According to the first aspect of the present invention, the placement of the projection part with respect to the helical wall part is determined such that the central axis line of the projection part and the central axis line of the camshaft perpendicularly intersect with each other in a state in which the projection part is protruded toward the guide rail by the actuator. This enables to determine the placement of the projection part with respect to the helical wall part so as not to be affected by the inclination of the helical wall part. According to the present invention, it is thereby possible to secure a contact area between the helical wall part and the projection part, thereby successfully reducing a contact pressure generated between the two.

According to the second to fourth aspects of the present invention, a local contact with the helical wall part is avoided, thus making it possible to secure a contact range between the helical wall part and the projection part widely in a line shape from the bottom part to the upper part of the helical wall part. It is thereby possible to effectively reduce the contact pressure generated between the helical wall part and the projection part.

According to the fifth aspect of the present invention, it is possible to ensure the reliability of inserting the projection part into the guide rail.

According to the sixth aspect of the present invention, it is possible to ensure the reliability of inserting the projection part into the guide rail. Moreover, as a result of configuring the guide surface to be a surface inclined downward of the helical wall part, it is possible to prevent the projection part and the helical wall part from being brought into engagement when the projection part and the helical wall part come into contact with each other in a situation in which the projection part is not protruded by the actuator.

DESCRIPTION OF SYMBOLS

Figure 1:
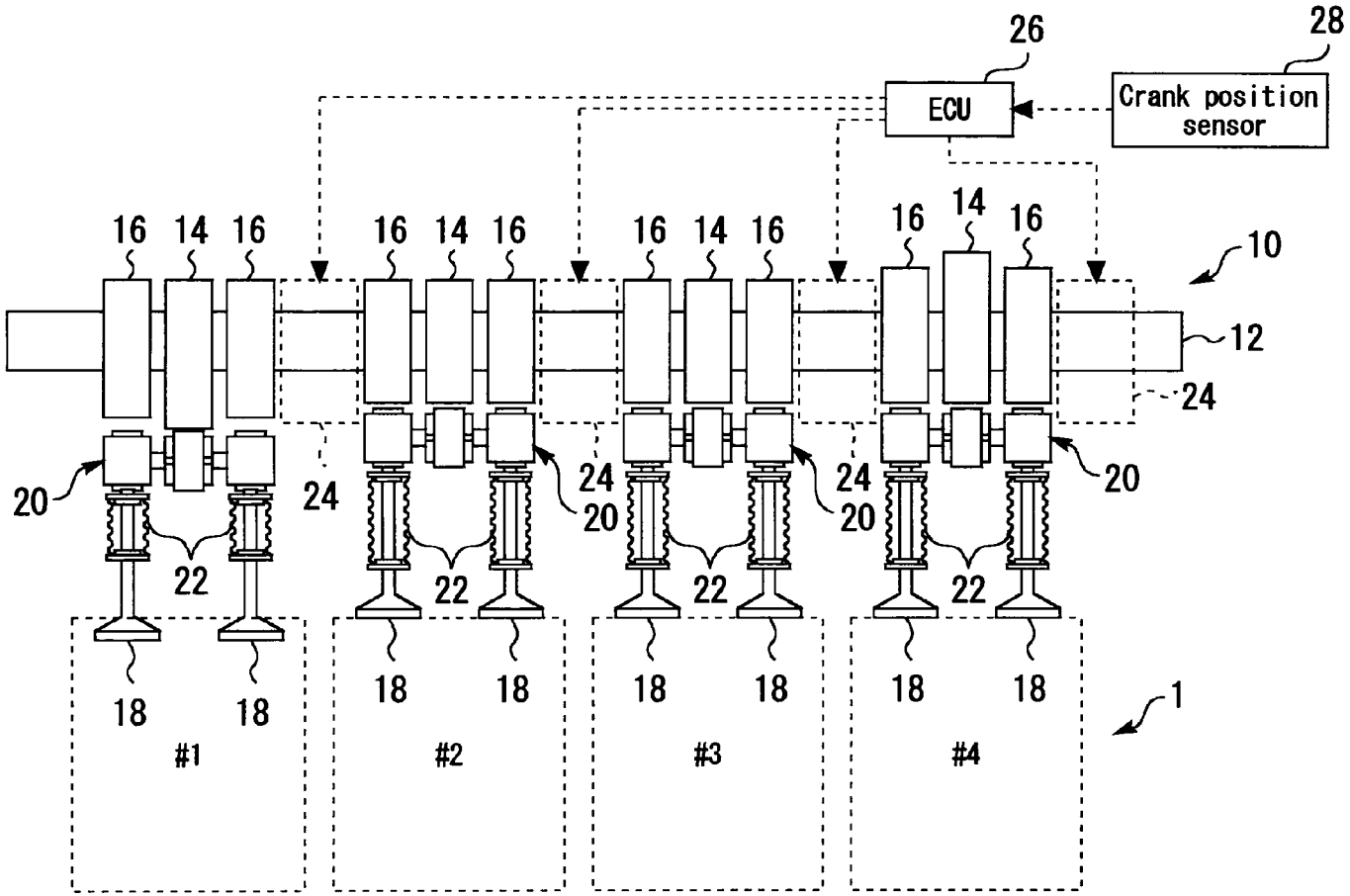
FIG. 1 is a schematic diagram showing the overall configuration of a variable valve operating apparatus for an internal combustion engine 1 according to a first embodiment of the present invention.

1 internal combustion engine
10 variable valve operating apparatus
12 camshaft
14 main cam
16 auxiliary cam
18 valve

20 variable mechanism
24 changeover mechanism
26 ECU (Electronic Control Unit)
32 first rocker arm
34L, 34R second rocker arm
48 first changeover pin
54L, 54R second changeover pin
56 return spring
58, 80, 90 slide pin
58*c*, 80*c*, 90*c* projection part
62 circular column part
64, 92, 94 guide rail
64*a* proximal end
64*b* terminal end
64*c* shallow bottom part
64*d*, 92*d*, 94*d* load bearing surface (side wall surface)
64*e* opposing surface (side wall surface)
66 actuator
68 solenoid
70 lock pin
82 spring plate
83, 102 permanent magnet
86 electric magnet
88 oil injection nozzle
90*f* guide surface on projection part side
92*f* guide surface on guide rail side
96 torsion coil spring
100 compression coil spring
Pmax1, Pmax2 displacement end

DESCRIPTION OF EMBODIMENTS

First Embodiment

First, a first embodiment of the present invention will be described with reference to FIGS. 1 to 15.

[Overall Configuration of Variable Valve Operating Apparatus]

FIG. 1 is a schematic diagram showing the overall configuration of a variable valve operating apparatus 10 for an internal combustion engine 1 according to the first embodiment of the present invention.

Here, the internal combustion engine 1 is supposed to be a straight 4-cylinder engine having four cylinders (#1 to #4) in which the combustion stroke take places in the order from #1 to #3, to #4, and to #2. Moreover, suppose that two intake valves and two exhaust valves are provided in each cylinder of the internal combustion engine 1. Thus, it is supposed that the configuration shown in FIG. 1 functions as a mechanism to drive two intake valves or two exhaust valves disposed in each cylinder.

The variable valve operating apparatus 10 of the present embodiment includes a camshaft 12. The camshaft 12 is connected to a crankshaft, which is not shown, by means of a timing chain or a timing belt and is configured to rotate at a half speed of that of the crankshaft. The camshaft 12 is formed with a main cam 14 and two auxiliary cams 16 for one cylinder. The main cam 14 is disposed between two auxiliary cams 16.

The main cam 14 includes an arc-shaped base circle part 14*a* (see FIG. 3) concentric with the camshaft 12, and a nose part 14*b* (see FIG. 3) which is formed such that a part of the base circle expands outwardly in the radial direction. Moreover, in the present embodiment, the auxiliary cam 16 is configured to be a cam which includes only a base circle part (a zero lift cam) (see FIG. 4).

A variable mechanism 20 is interposed between the cam 14, 16 and the valve 18 of each cylinder. That is, the acting forces of the cams 14 and 16 are arranged to be transferred to the two valves 18 via the variable mechanism 20. The valve 18 is adapted to be opened and closed by use of the acting force of the cams 14 and 16, and the biasing force of valve spring 22.

The variable mechanism 20 is a mechanism to change the valve-opening characteristics of the valve 18 by switching between the state in which the acting force of the main cam 14 is transferred to the valve 18 and the state in which the acting force of the auxiliary cam 16 is transferred to the valve 18. Note that, in the present embodiment, since the auxiliary cam 16 is a zero-lift cam, the state in which the acting force of the auxiliary cam 16 is transferred to the valve 18 refers to a state in which neither opening nor closing of the valve 18 take place (a valve halted state).

Moreover, the variable valve operating apparatus 10 of the present embodiment includes, for each cylinder, a changeover mechanism 24 for driving each variable mechanism 20 to switch between operational states of the valve 18. The changeover mechanism 24 is adapted to be driven according to a driving signal from an ECU (Electronic Control Unit) 26. The ECU 26, which is an electronic control unit for controlling the operating state of the internal combustion engine 1, controls the changeover mechanism 24 based on the output signal of a crank position sensor 28 and the like. The crank position sensor 28 is a sensor for detecting a rotational speed of the output shaft (crankshaft) of the internal combustion engine 1.

(Configuration of Variable Mechanism)

Next, a detailed configuration of the variable mechanism 20 will be described with reference to FIGS. 2 to 4.

Figure 2:
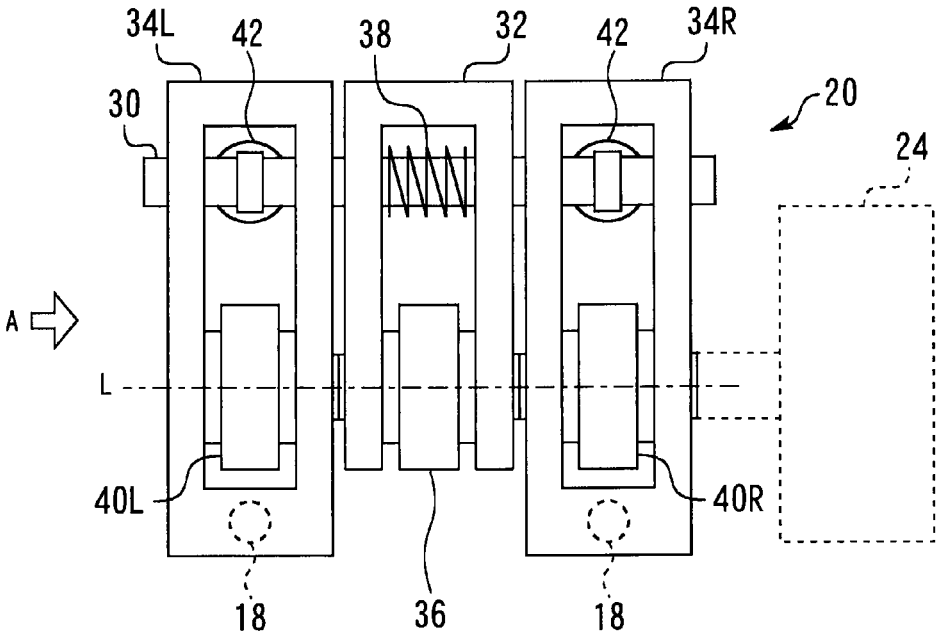
FIG. 2 is a look-down view of a variable mechanism shown in FIG. 1 seen from the proximal end part side of a valve.

FIG. 2 is a look-down view of the variable mechanism 20 shown in FIG. 1 seen from the proximal end part side of the valve 18.

The variable mechanism 20 includes a rocker shaft 30 which is disposed in parallel with the camshaft 12. As shown in FIG. 2, a first rocker arm 32 and a pair of second rocker arms 34R and 34L are rotatably attached to the rocker shaft 30. The first rocker arm 32 is disposed between the two second rocker arms 34R and 34L. Note that, in the present description, the right and left second rocker arms 34R and 34L may be referred to simply as a second rocker arm 34 when they are not particularly discriminated.

Figure 3:
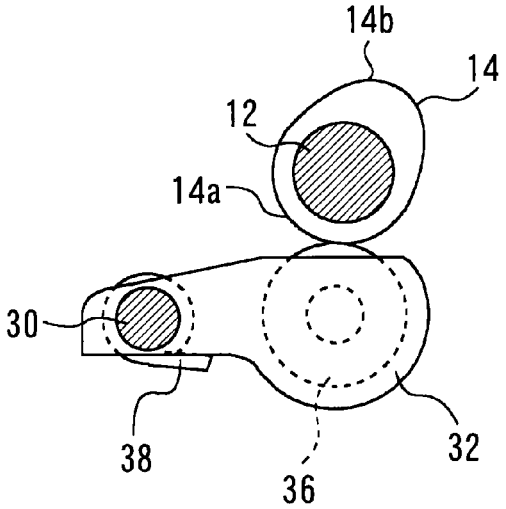
FIG. 3 is a view of a first rocker arm seen from the axial direction (the direction shown by an arrow A in FIG. 2) of a rocker shaft.
Figure 4:
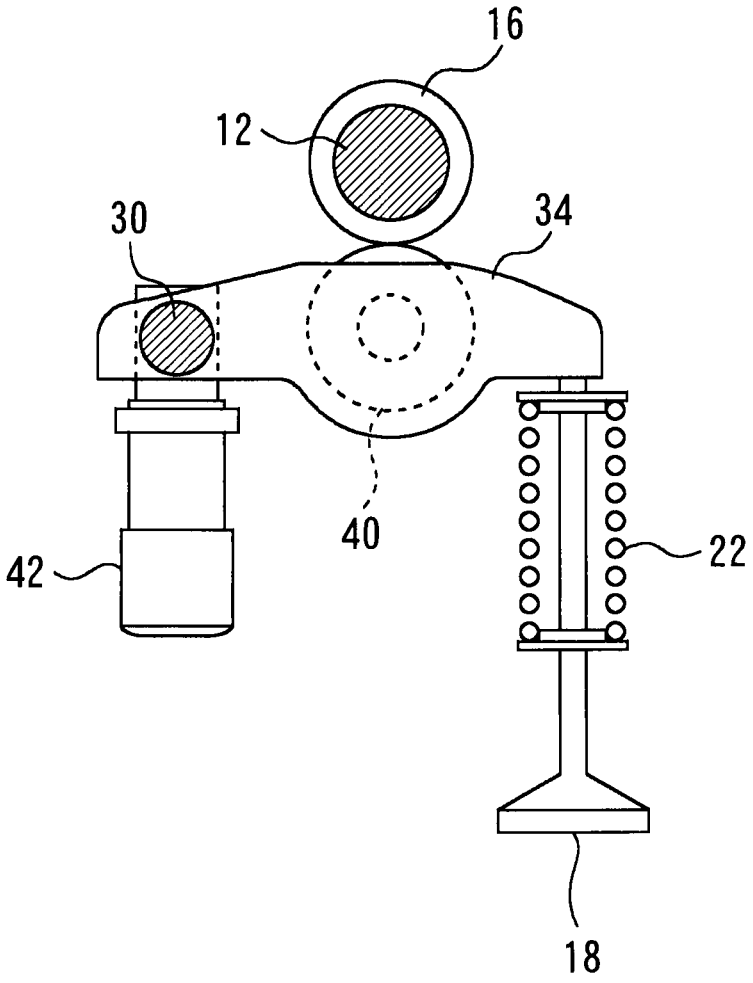
FIG. 4 is a view of a second rocker arm seen from the axial direction (the direction shown by the arrow A) of the rocker shaft in the same manner as in FIG. 3.

FIG. 3 is a view of the first rocker arm 32 seen from the axial direction (the direction shown by an arrow A in FIG. 2) of the rocker shaft 30, and FIG. 4 is a view of the second rocker arm 34 seen from the axial direction (the direction shown by the arrow A) of the rocker shaft 30 in the same manner as in FIG. 3.

As shown in FIG. 3, a first roller 36 is rotatably attached to the end part opposite to the rocker shaft 30 in the first rocker arm 32 at a position which allows a contact with the main cam 14. The first rocker arm 32 is biased by a coil spring 38 attached to the rocker shaft 30 such that the first roller 36 is constantly in abutment with the main cam 14. The first rocker arm 32 configured as described above oscillates with the rocker shaft 30 as a fulcrum through the cooperation between the acting force of the main cam 14 and the biasing force of the coil spring 38.

On the other hand, as shown in FIG. 4, the proximal end part of the valve 18 (specifically, the proximal end part of the valve stem) is in abutment with the end part opposite to the rocker shaft 30 in the second rocker arm 34. Moreover, a second roller 40 is rotatably attached to a central portion of the second rocker arm 34. Note that the outer diameter of the second roller 40 is equal to the outer diameter of the first roller 36.

Moreover, it is supposed that the rocker shaft 30 is supported by a cam carrier (or, for example, a cylinder head), which is a stationary member of the internal combustion engine 1, via a rush adjuster 42 at the other end of the second rocker arm 34. Therefore, the second rocker arm 34 is biased toward the auxiliary cam 16 by being subjected to an upward force from the rush adjuster 42. Note that when the auxiliary cam is a lift cam including a nose part unlike a zero lift cam of the present embodiment, the second rocker arm 34 is pressed against the auxiliary cam by the valve spring 22 while the auxiliary cam lifts up the valve 18.

Further, the position of the second roller 40 with respect to the first roller 36 is defined such that the axial center of the second roller 40 and the axial center of the first roller 36 are positioned on the same straight line L as shown in FIG. 2, when the first roller 36 is in abutment with the base circle part 14*a* of the main cam 14 (see FIG. 3) and the second roller 40 is in abutment with the base circle part of the auxiliary cam 16 (see FIG. 4).

(Configuration of Changeover Mechanism)

Next, a detailed configuration of the changeover mechanism 24 will be described with reference to FIGS. 5 and 6.

The changeover mechanism 24, which is a mechanism for switching the connection and disconnection concerning the first rocker arm 32 and the second rocker arm 34, makes it possible to switch the operational states of the valve 18 between a valve operable state and valve stop state by switching the state in which the acting force of the main cam 14 is transferred to the second rocker arm 34 and the state in which the forgoing acting force is not transferred to the second rocker arm 34.

Figure 5:
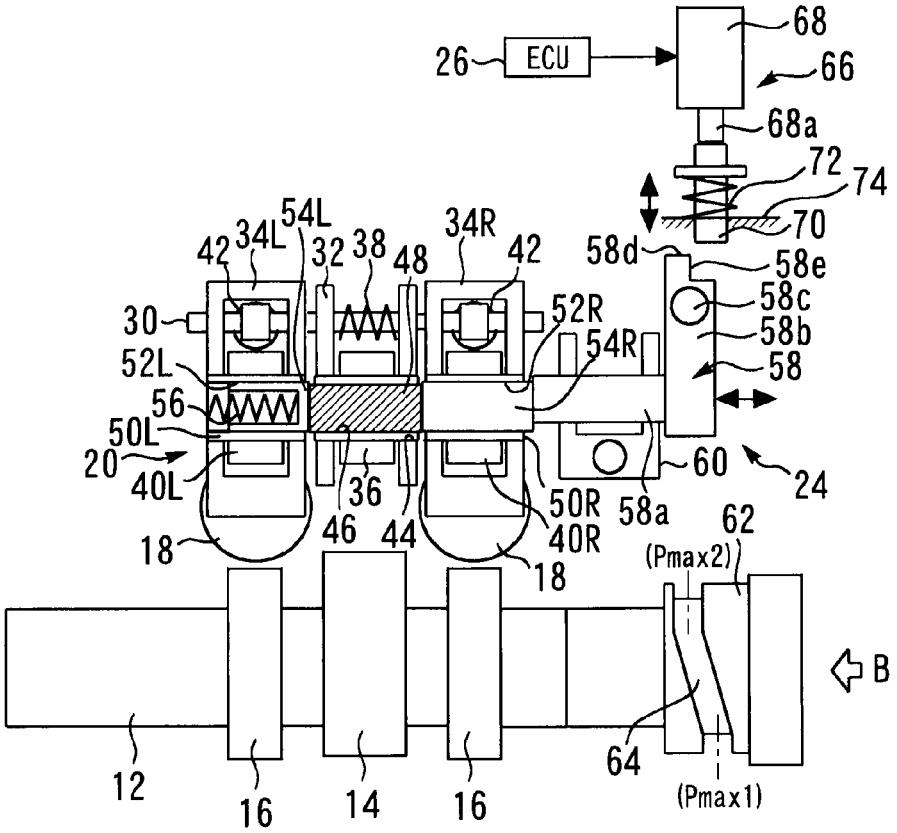
FIG. 5 is a diagram illustrating a detailed configuration of a changeover mechanism shown in FIG. 1.

FIG. 5 is a diagram illustrating a detailed configuration of the changeover mechanism 24 shown in FIG. 1. Note that, in FIG. 5, the variable mechanism 20 is represented by using a section taken at the axial centers of the rollers 36 and 40. Moreover, for the sake of simplicity of description, the mounting position of the camshaft 12 with respect to the mounting position of the variable mechanism 20 is represented in a state different from the actual mounting position excepting the axial position of the camshaft 12.

As shown in FIG. 5, a first pin hole 46 is formed within a first spindle 44 of the first roller so as to pass through in its axial direction, and the both ends of the first pin hole 46 are opened to both side surfaces of the first rocker arm 32. A first changeover pin 48 having a circular column shape is slidably inserted into the first pin hole 46.

On the other hand, there is formed inside a second spindle 50L of the second roller 40 of the second rocker arm 34L side, a second pin hole 52L of which end part opposite to the first rocker arm 32 is closed and of which end part of the first rocker arm 32 side is opened. Moreover, inside a second spindle 50R of the second roller 40 of the second rocker arm 34R side, a second pin hole 52R is formed so as to pass through in its axial direction, and both ends of the second pin hole 52R are opened to the both side surfaces of the second rocker arm 34R.

A second changeover pin 54L of a circular column shape is slidably inserted into the second pin hole 52L. Moreover, inside the second pin hole 52L, there is disposed a return spring 56 which biases the second changeover pin 54L toward the first rocker arm 32 direction (hereafter, referred to as the "advancing direction of changeover pin"). A second changeover pin 54R of a circular column shape is slidably inserted into the second pin hole 52R.

The relative positions of three pin holes 46, 52L, and 52R described so far are defined such that the axial centers of the three pin holes 46, 52L, and 52R are positioned on the same straight line L, when the first roller 36 is in abutment with the base circle part 14*a* of the main cam 14 (see FIG. 3) and the second roller 40 is in abutment with the base circle part of the auxiliary cam 16 (see FIG. 4).

Figure 6:
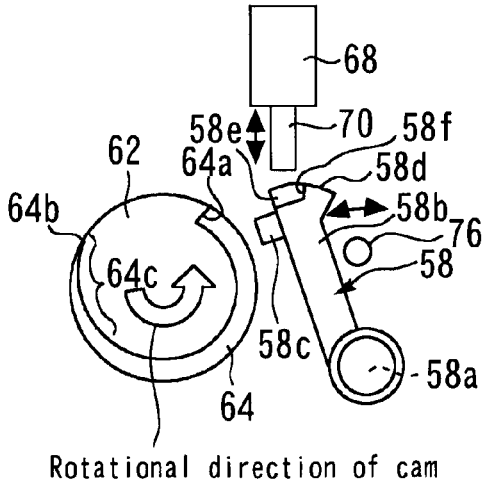
FIG. 6 is a view of the changeover mechanism seen from the axial direction of a camshaft (the direction of an arrow B in FIG. 5)

Here, newly referring to FIG. 6 as well as above-described FIG. 5, description on the changeover mechanism 24 will be continued. FIG. 6 is a view of the changeover mechanism 24 seen from the axial direction of the camshaft 12 (the direction of an arrow B in FIG. 5). Note that in the figures following FIG. 6, the relation between a rock pin 70 and a solenoid 68 is illustrated in a simplified form.

The changeover mechanism 24 includes a slide pin 58 for forcing the changeover pins 48, 54L, and 54R to be displaced toward the second rocker arm 34L side (in the retreating direction of the changeover pin) with the aid of the rotational power of the cam. The slide pin 58 includes, as shown in FIG. 5, a circular column part 58*a* having a end face which is in abutment with the end face of the second changeover pin 54R. The circular column part 58*a* is supported by a support member 60 fixed to the cam carrier so as to be advanceable/retreatable in the axial direction and rotatable in the circumferential direction.

Moreover, a bar-like arm part 58*b* is provided so as to protrude outwardly in the radial direction of the circular column part 58*a* at the end part opposite to the second changeover pin 54R in the circular column part 58*a*. That is, the arm part 58*b* is configured to be rotatable around the axial center of the circular column part 58*a*. The distal end part of the arm part 58*b* is configured, as shown in FIG. 6, to extend up to a position opposed to the peripheral surface of the camshaft 12. Moreover, a circular projection part 58*c* is provided at the distal end part of the arm part 58*b* so as to protrude toward the peripheral surface of the camshaft 12.

There is formed in the outer peripheral surface opposed to the projection part 58*c* in the camshaft 12, a circular column part 62 having a larger diameter than that of the camshaft 12. There is formed in the peripheral surface of the circular column part 62, a helical-shaped guide rail 64 extending in the circumferential direction. Here, the guide rail 64 is shaped as a helical groove.

Moreover, the changeover mechanism 24 includes an actuator 66 for inserting the projection part 58*c* into the guide rail 64. To be more specific, the actuator 66 includes a solenoid 68 which is duty controlled based on the command from the ECU 26 and a lock pin 70 which is in abutment with the drive axis 68*a* of the solenoid 68. The lock pin 70 is formed into a cylindrical shape.

One end of the spring 72, which exerts a biasing force against the thrust of the solenoid 68, is fixedly engaged to the lock pin 70 and the other end of the spring 72 is fixedly engaged to a support member 74 fixed to the cam carrier which is a stationary member. According to such configuration, when the solenoid 68 is driven based on the command from the ECU 26, the lock pin 70 can be advanced as a result of the thrust of the solenoid 68 overpowering the biasing force of the spring 72 and, on the other hand, when the driving of the solenoid 68 is stopped, the lock pin 70 and the driving shaft 68*a* can be quickly retreated to a predetermined position by the biasing force of the spring 72. Moreover, the lock pin 70 is restricted from moving in its radial direction by the support member 74.

Moreover, it is supposed that the solenoid 68 is fixed to a stationary member such as a cam carrier, at a position where the lock pin 70 can press the pressing surface (the surface opposite to the surface where the projection part 58*c* is provided) 58*d* of the distal end part of the arm part 58*b* of the slide pin 58 against the guide rail 64. In other words, the pressing surface 58*d* is provided in a shape and at a position where the projection part 58*c* can be pressed toward the guide rail 64 by the lock pin 70.

The arm part 58*b* of the slide pin 58 is arranged to be rotatable around the axial center of the circular column part 58*a* within a range restricted by the circular column part 62 of the camshaft 12 side and a stopper 76. Then, the positional relationship of each component is arranged such that when the arm part 58*b* is within the abovementioned range, and when the axial position of the slide pin 58 is at a displacement end Pmax1 described later, the lock pin 70 driven by the solenoid 68 can come into abutment with the pressing surface 58*d* of the arm part 58*b* securely.

The helical direction in the guide rail 64 of the camshaft 12 is arranged such that when the camshaft 12 is rotated in a predetermined rotational direction shown in FIG. 6 with the projection part 58*c* being inserted thereinto, the slide pin 58 causes the changeover pins 48, 54L, and 54R to be displaced in the direction approaching the rocker arms 32 and 34 while pushing aside them in the retreating direction against the biasing force of the return spring 56.

Here, the position of the slide pin 58, in a state where the second changeover pin 54L is inserted into both the second pin hole 52L and the first pin hole 46 by the biasing force of the return spring 56, and where the first changeover pin 48 is inserted into both the first pin hole 46 and the second pin hole 52R, is referred to as a "displacement end Pmax1". When the slide pin 58 is positioned at this displacement end Pmax1, the first rocker arm 32 and the second rocker arms 34R and 34L all become connected with each other. Moreover, the position of the slide pin 58 in a state where as a result of the changeover pin 48 and the like being subjected to a force from the slide pin 58, the second changeover pin 54L, the first changeover pin 48, and the second changeover pin 54R are respectively inserted only into the second pin hole 52L, the first pin hole 46, and the second pin hole 52R, is referred to as a "displacement end Pmax2". That is, when the slide pin 58 is positioned at this displacement end Pmax2, the first rocker arm 32, and the second rocker arms 34R and 34L are all disconnected from each other.

In the present embodiment, the position of the proximal end 64*a* of the guide rail 64 in the axial direction of the camshaft 12 is arranged so as to coincide with the position of the projection part 58*c* when the slide pin 58 is positioned at the above-described displacement end Pmax1. Further, the position of the terminal end 64*b* of the guide rail 64 in the axial direction of the camshaft 12 is arranged so as to coincide with the position of the projection part 58*c* when the slide pin 58 is positioned at the above-described displacement end Pmax2. That is, in the present embodiment, the configuration is made such that the slide pin 58 is displacable between the displacement end Pmax1 and the displacement end Pmax2 within the range in which the projection part 58*c* is guided by the guide rail 64.

Further, as shown in FIG. 6, the guide rail 64 of the present embodiment is provided with a shallow bottom part 64*c*, in which the depth of the guide rail 64 gradually decreases as the camshaft 12 rotates, as a predetermined section of the terminal end 64*b* side after the slide pin 58 reaches the displacement end Pmax2. Note that the depth of the portion other than the shallow bottom part 64*c* in the guide rail 64 is constant.

Moreover, the arm part 58*b* in the present embodiment is provided with a notch part 58*e* which is formed into a concave shape by notching a part of a pressing surface 58*d*. The pressing surface 58*d* is provided so as to be kept in abutment with the lock pin 70 while the slide pin 58 is displaced from the displacement end Pmax1 to the displacement end Pmax2. Further, the notch part 58*e* is provided in a portion where it can be engaged with the lock pin 70 when the projection part 58*c* is taken out on the surface of the circular column part 62 by the action of the above-described shallow bottom part 64*c*, in a state where the slide pin 58 is positioned at the above-described displacement end Pmax2.

Moreover, the notch part 58*e* is formed so as to be engaged with the lock pin 70 in a mode in which the rotation of the arm part 58*b* in the direction in which the projection part 58*c* is inserted into the guide rail 64 can be restricted, and the movement of the slide pin 58 in the advancing direction of the changeover pin can be restricted. There is provided in the notch part 58*e*, a guide surface 58*f* which guides the slide pin 58 to move away from the circular column part 62 as the lock pin 70 moves into the notch part 58*e*.

[Operation of the Variable Valve Operating Apparatus of the Present Embodiment]

Next, the operation of the variable valve operating apparatus 10 will be described with reference to FIGS. 7 to 10.

(At the Time of Valve Operating State)

Figure 7:
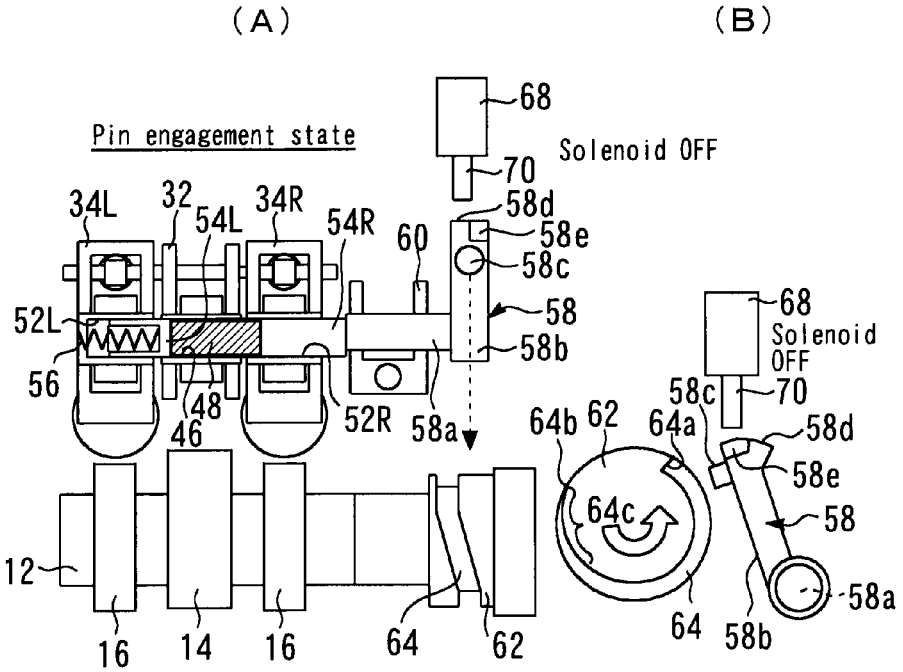
FIG. 7 is a diagram showing a control state during a valve operating state (normal lift operation)

FIG. 7 is a diagram showing a control state during a valve operating state (normal lift operation).

In this case, as shown in FIG. 7(B), the driving of the solenoid 68 is turned OFF and thus the slide pin 58 is positioned at the displacement end Pmax1 being separated from the camshaft 12 and subjected to the biasing force of the return spring 56. In this state, as shown in FIG. 7(A), the first rocker arm 32 and the two second rocker arms 34 are connected via the changeover pins 48 and 54L. As a result of that, the acting force of the main cam 14 is transferred from the first rocker arm 32 to both the valves 18 via the left and right second rocker arms 34R and 34L. Thus, the normal lift operation of the valve 18 is performed according to the profile of the main cam 14.

(At the Start of Valve Stop Operation (The Start of Slide Operation))

Figure 8:
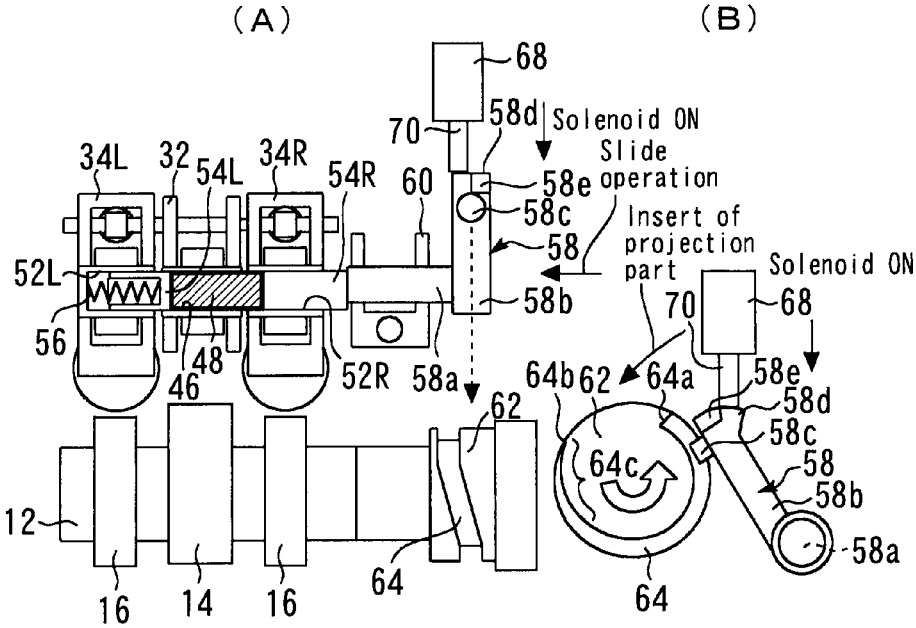
FIG. 8 is a diagram showing a control state at the start of a valve stop operation.

FIG. 8 is a diagram showing a control state at the start of a valve stop operation.

The valve stop operation is performed when, for example, an execution request of a predetermined valve stop operation such as a fuel cut request of the internal combustion engine 1 is detected by the ECU 26. Since the valve stop operation of the present embodiment is an operation to displace the changeover pins 48, 54L, and 54R in their retreating direction by means of the slide pin 58 with the aid of the rotational force of the camshaft 12, such operation needs to be performed while the axial centers of these changeover pins 48, 54L, and 54R are positioned on the same straight line, that is, while the first rocker arm 32 is not oscillating.

In the present embodiment, the guide rail 64 is arranged such that a section in which the slide pin 58 is displaced in the retreating direction of changeover pins (sliding section) is within the base circle section. As a result of this, when the ECU 26 detects an execution request for a predetermined valve stop operation, with the solenoid 68 being driven in the order starting from a cylinder at which the base circle section first arrives, as shown in FIG. 8(B), the projection part 58*c* is inserted into the guide rail 64, thereby successively starting the valve stop operation of each cylinder. More specifically, as the projection part 58*c* which has been inserted into the guide rail 64 being guided by the guide rail 64, a slide operation of the slide pin 58 is started toward the displacement end Pmax2 side, as shown in FIG. 8(A), with the aid of the rotational force of the camshaft 12. During the execution of the slide operation, the slide pin 58 moves toward the displacement end Pmax2, in a state in which the biasing force of the return spring 56 is received by the projection part 58*c* being in abutment with the side wall surface of the guide rail 64 (load bearing surface 64*d*).

(At the Completion of Slide Operation)

Figure 9:
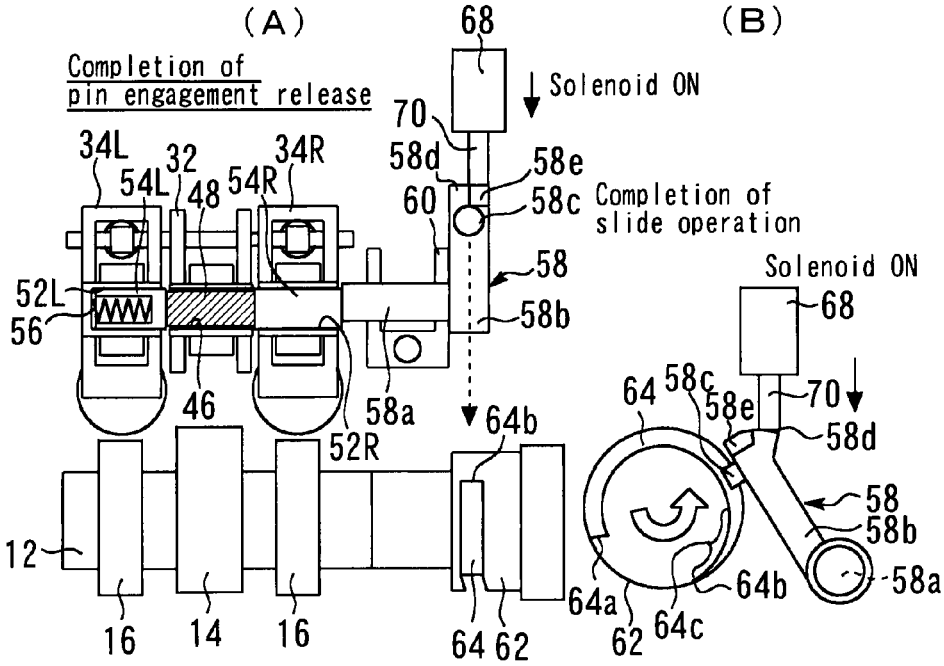
FIG. 9 is a diagram showing a control state at the completion of the slide operation.

FIG. 9 is a diagram showing a control state at the completion of the slide operation.

FIG. 9(A) shows a timing at which the slide pin 58 has reached the displacement end Pmax2 and the slide operation at the time of a valve stop request is completed, that is, a timing at which the connection between the first rocker arm 32 and the second rocker arms 34R and 34L is released as a result of the first changeover pin 48 and the second changeover pin 54L becoming accommodated into the first pin hole 46 and the second pin hole 52L, respectively. Moreover, at this timing, as shown in FIG. 9(B), the position of the projection part 58*c* within the guide rail 64 has not yet reached the shallow bottom part 64*c*.

When the slide operation is completed as shown above, and the first rocker arm 32 and the second rocker arms 34R and 34L become disconnected, the first rocker arm 32, which is biased by the coil spring 38 toward the main cam 14 as the main cam 14 rotates, comes to oscillate by itself. As a result of this, the acting force of the main cam 14 is not transferred to the two second rocker arms 34. Further, since the auxiliary cam 16, against which the second rocker arm 34 abuts, is a zero lift cam, the force for driving the valve 18 is no more provided to the second rocker arms 34, to which the acting force of the main cam 14 has come not to be transferred. As a result of that, since, regardless of the rotation of the main cam 14, the second rocker arm 34 comes into a stationary state, the lift operation of the valve 18 becomes stopped at the valve closing position.

(At the Time of Holding Operation of Displacement Member)

Figure 10:
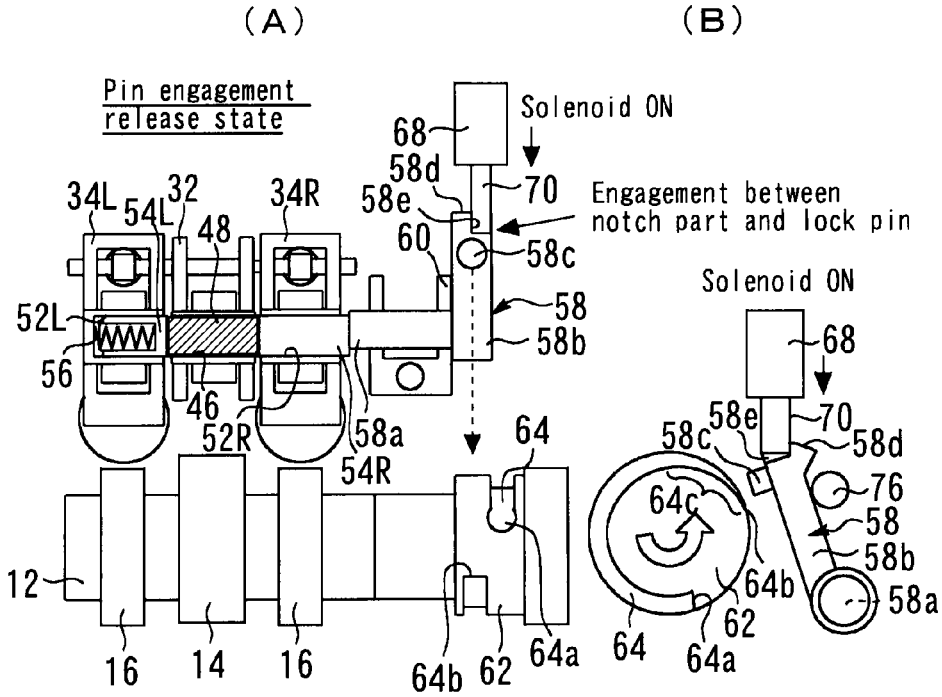
FIG. 10 is a diagram showing a control state at the time of holding operation to hold a slide pin with a lock pin.

FIG. 10 is a diagram showing a control state at the time of holding operation to hold the slide pin 58 with the lock pin 70.

When the camshaft 12 further rotates after the slide operation shown in above-described FIG. 10 is completed, the projection part 58*c* comes close to the shallow bottom part 64*c* in which the depth of the groove gradually decreases. As a result of that, the action of the shallow bottom part 64*c* causes the slide pin 58 to rotate in the direction separated from the camshaft 12. Then, as the depth of the groove decrease due to the shallow bottom part 64*c*, the lock pin 70 is displaced a little in its retreating direction. Thereafter, when the slide pin 58 further rotates until the lock pin 70 which is constantly driven by the solenoid 68, coincides with the notch part 58*e*, the portion of the slide pin 58 side, which is to be abutment with the lock pin 70, is switched from the pressing surface 58*d* to the notch part 58*e*.

As a result of that, the lock pin 70 comes to be engaged with the notch part 58*e*. As a result of this, as shown in FIG. 10(B), the slide pin 58 comes to be held with the projection part 58*c* being separated from the camshaft 12, and with the biasing force of the return spring 56 being received by the lock pin 70. For this reason, in this holding operation, as shown in FIG. 10(A), the state in which the first rocker arm 32 and the second rocker arm 34 are disconnected, that is, the valve stop state is maintained.

(At the Time of Valve Return Operation)

A valve return operation for returning the operation from the valve stop state to the valve operating state, for example, when an execution request of a predetermined valve return operation such as a request for returning from a fuel cut is detected by the ECU 26. Such valve return operation is started by the ECU 26 turning OFF the energization to the solenoid 68 at a predetermined timing (timing that is earlier than the start timing of the base circle section, in which the changeover pin 48 and the like are movable, by a predetermined time period needed for the operation of the solenoid 68), in a control state shown in FIG. 10. When the energization to the solenoid 68 is turned OFF, the engagement between the notch part 58*e* of the slide pin 58 and the lock pin 70 is released. As a result of that, the force to hold the first changeover pin 48 and the second changeover pins 54L respectively in the first pin hole 46 and the second pin hole 52L against the biasing force of the return spring 56 disappears.

Because of this, when the base circle section in which the positions of changeover pins 48, 54L, and 54R coincide arrives, the changeover pins 48 and 54L moves in the advancing direction by the biasing force of the return spring 56, thereby returning into a state in which the first rocker arm 32 and the two second rocker arms 34 are connected via the changeover pins 48 and 54L, that is, a state in which a lift operation of the valve 18 is enabled by the acting force of the main cam 14. Moreover, as the changeover pins 48 and 54L moves in the advancing direction by the biasing force of the return spring 56, the slide pin 58 is returned from the displacement end Pmax2 to the displacement end Pmax1 via the second changeover pin 54R.

(Summary)

According to the variable valve operating apparatus 10 of the present embodiment thus configured, it becomes possible to switch the operational states of the valve 18 between the valve operating state and the valve stop state by moving the axial position of the slide pin 58 between the displacement end Pmax1 and the displacement end Pmax2, with the aid of the ON and OFF of the energization of the solenoid 68, the rotational force of the camshaft 12, and the biasing force of the return spring 56.

[Problem in Reducing Contact Pressure Generated between Guide Rail and Slide Pin]

Figure 11:
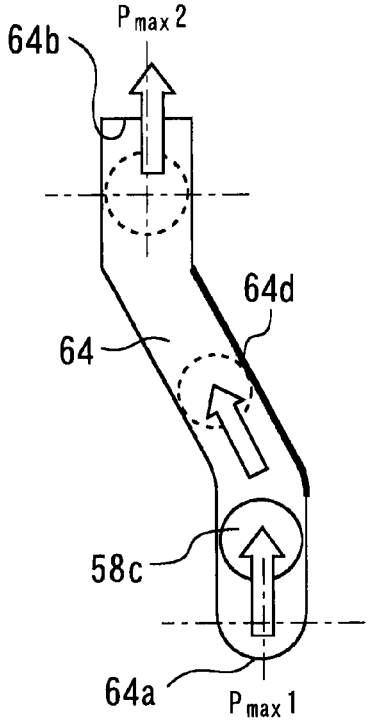
FIG. 11 is a developed view of a guide rail.

FIG. 11 is a developed view of the guide rail 64.

The slide pin 58 is subject to a biasing force of the return spring 56 via the changeover pin 48 and the like. Therefore, as the slide pin 58 moves by being guided by the guide rail 64 from the displacement end Pmax1 to the displacement end Pmax2 as shown in FIG. 11, the projection part 58*c* of the slide pin 58 moves within the guide rail 64 resisting the biasing force of the return spring 56 while being pressed against one of the side wall surfaces 64*d* of the guide rail 64. Here, this side wall surface 64*d* is particularly referred to as a "load bearing surface 64*d*". Also the load that is generated between the load bearing surface 64*d* and the projection part 58*c* when the projection part 58*c* of the slide pin 58 slides in the guide rail 64 while being pressed against the load bearing surface 64*d*, is referred to as a "contact load". Moreover, the "contact pressure" generated between the load bearing surface 64*d* and the projection part 58*c* has a value of the above described contact load divided by the contact area of the two.

Figure 12:
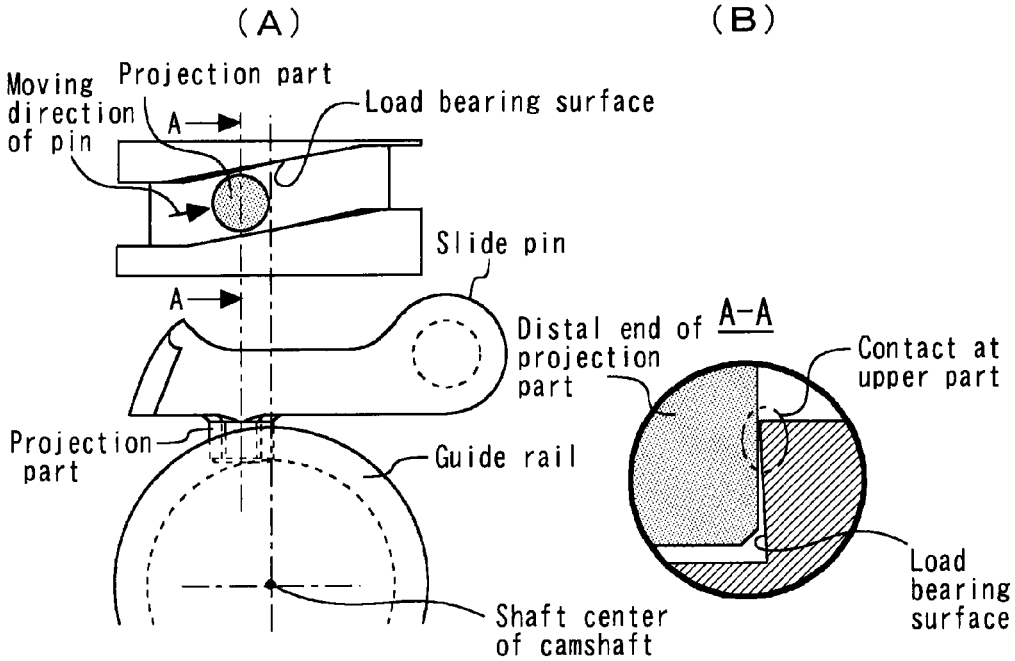
FIG. 12 is a diagram to show a configuration which is referred for comparison with the first embodiment of the present invention.

FIG. 12 is a diagram to show a configuration which is referred for comparison with the first embodiment of the present invention. More specifically, the figure shown in the lower part of FIG. 12(A) is a view of the slide pin and the guide rail viewed from the axial direction of the camshaft, and the figure shown in the upper part of FIG. 12(A) is a view of the slide pin and the guide rail viewed from the central axis line direction of the projection part of the slide pin. FIG. 12(B) is a cross sectional view taken along the A-A line in FIG. 12(A).

In the configuration shown in FIG. 12(A), the placement of the slide pin with respect to the guide rail is determined in a state in which the central axis line of the projection part of the slide pin is offset with respect to the central axis line of the camshaft. It is seen from FIG. 12(B) that when such a placement method is used, the load bearing surface and the projection part are in contact with each other only at the upper part of the load bearing surface of the guide rail. Such a contact mode causes the contact area between the load bearing surface and the projection part to decrease (become a point contact). Thereby, the contact pressure (contact load/contact area) generated between the two becomes increased.

[Characteristic Configuration of First Embodiment]

Figure 13:
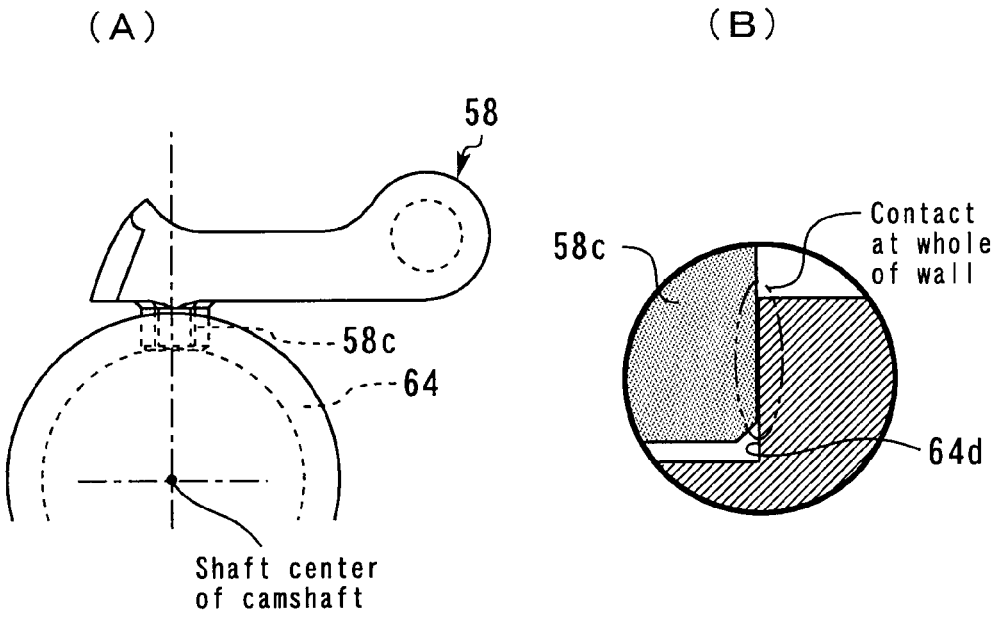
FIG. 13 is a diagram to illustrate the placement method of the slide pin with respect to the guide rail, which is used in the first embodiment of the present invention.

FIG. 13 is a diagram to illustrate the placement method of the slide pin 58 with respect to the guide rail 64, which is used in the first embodiment of the present invention.

As shown in FIG. 13(A), in the present embodiment, the placement of the projection part 58*c* with respect to the guide rail 64 is determined such that the central axis line of the projection part 58*c* and the central axis line of the camshaft 12 (the central axis line of the helical wall part (load bearing surface 64*d*)) perpendicularly intersect in a state in which the projection part 58*c* of the slide pin 58 is protruded to the guide rail 64 by the actuator 66. According to such a placement method, compared to the placement method as shown in FIG. 12 described above, the side face of the projection part 58*c* and the load bearing surface 64*d* is opposed to each other in parallel as shown in FIG. 13(B). This causes the contact area between the load bearing surface 64*d* and the projection part 58*c* to increase (become a line contact), thereby allowing favorable reduction of the contact pressure generated between the two. Hereafter, referring to FIGS. 14 to 16, description will be made on the reason why it is possible to increase the contact area between the load bearing surface 64*d* and the projection part 58*c* by the placement method of the present embodiment.

Figure 14:
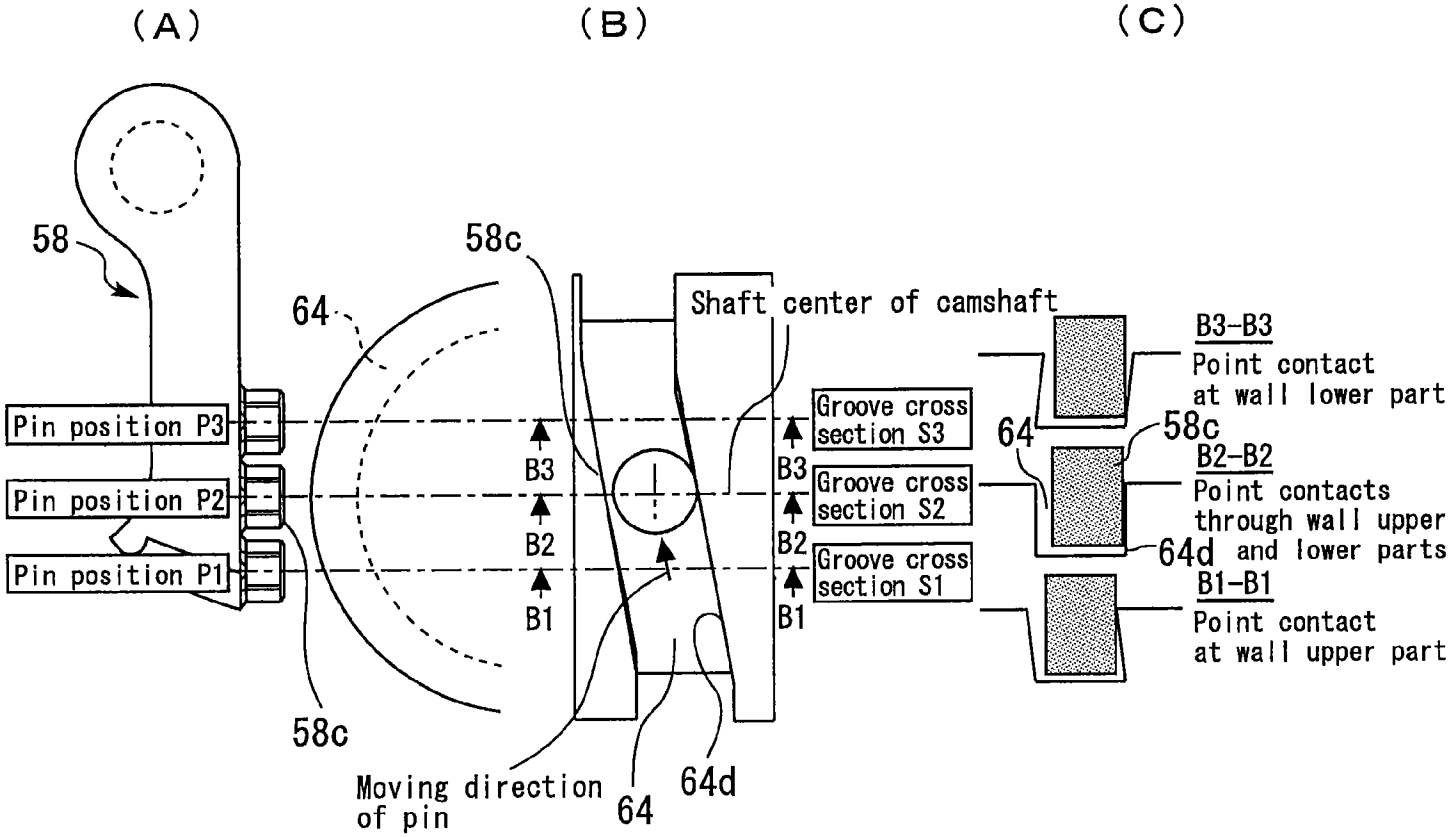
FIG. 14 is a diagram to illustrate that the way in which a projection part and a load bearing surface contact each other changes due to a change in the placement position of the slide pin with respect to the guide rail.

FIG. 14 is a diagram to illustrate that the way in which the projection part 58*c* and the load bearing surface 64*d* contact each other changes due to a change in the placement position of the slide pin 58 with respect to the guide rail 64. To be more specific, FIG. 14(A) is a view of the slide pin 58 and the guide rail 64 viewed from the axial direction of the camshaft 12; FIG. 14(B) is a view of the slide pin 58 and the guide rail 64 viewed from the direction of a straight line perpendicular to the central axis line of the camshaft 12 (that is, the central axis line of the projection part 58*c* in the placement method of the present embodiment); and FIG. 14(C) shows each cross section shown in FIG. 14(B). It is noted that the pin position P2 in FIG. 14 is the position of the projection part 58*c* determined by the above described placement method of the present embodiment, and that the pin position P1 is the position where the projection part 58*c* is placed at the backward side with respect to the pin position P2 in the moving direction of the projection part 58*c* in the guide rail 64 while the central axis line of the projection part 58*c* is maintained in parallel. Further, the pin position P3 is a position where the projection part 58*c* is placed, opposite to the pin position P1, at the forward side with respect to the pin position P2 in the moving direction of the projection part 58*c* in the guide rail 64.

As seen from the three pin positions P1 to P3 in FIG. 14, the fact that the contact area between the load bearing surface 64*d* and the projection part 58*c* becomes large at the pin position P2 where the placement method of the present embodiment is applied is related to the fact that the inclination of the load bearing surface (side wall surface) 64*d* of the guide rail 64 having a helical groove shape changes due to the change of the placement position of the slide pin 58 with respect to the guide rail 64. That is, the load bearing surface (side wall surface) 64*d* of the guide rail 64 becomes a plane perpendicular to the groove bottom surface (parallel with the view direction) at the pin position P2 as shown by the groove cross section S2 in FIG. 14(C) when viewed from the direction of a straight line perpendicularly intersecting with the central axis line of the camshaft 12 (the groove bottom surface of the guide rail). However, when the guide rail 64 is viewed from the same direction as the pin position P2, at the pin positions P1 and P3 which are forward and backward positions with respect to the pin position P2 in the moving direction of the projection part 58*c* in the guide rail 64, the load bearing surface (side wall surface) 64*d* of the guide rail 64 has an inclination with respect to the groove bottom surface as shown by the groove cross sections S1 and S3 in FIG. 14(C).

The reason why the inclination of the load bearing surface (side wall surface) 64*d* of the guide rail 64 changes along with each change of the pin positions P1 to P3 as described above is not due to an error during the cutting process of the guide rail 64, but due to a peculiar phenomenon which appears when a helical wall part (here, the guide rail 64 having a helical groove shape) is formed on a columnar object (here, a circular column part 62 of the camshaft 12). Hereafter, referring to FIGS. 15 and 16, the reason why the inclination of the load bearing surface (side wall surface) 64*d* of the guide rail 64 changes will be described in detail.

Figure 15:
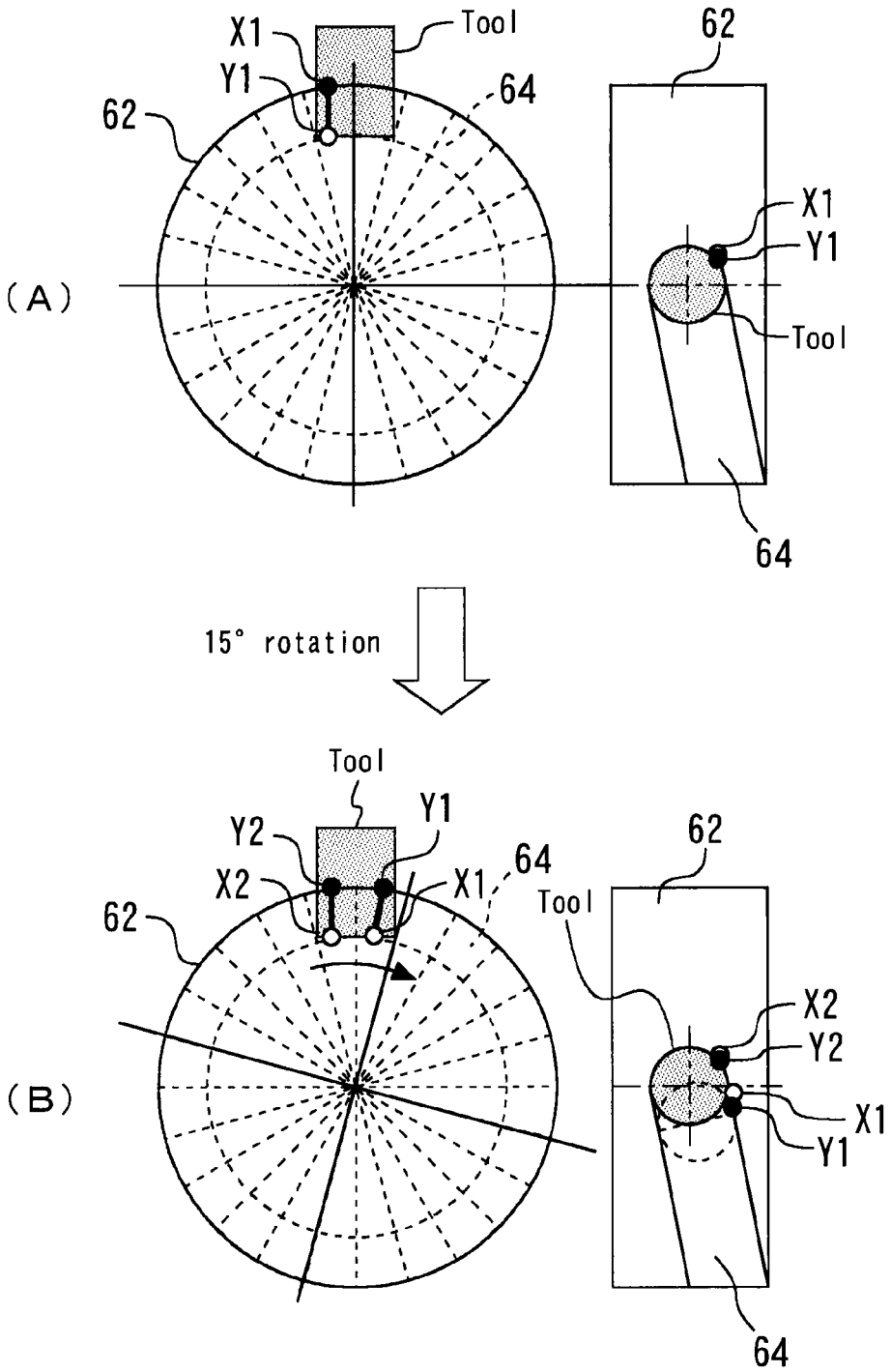
FIG. 15 is a diagram to illustrate the action when the guide rail having a helical groove shape is formed on a circular column part.

FIG. 15 is a diagram to illustrate the action when the guide rail 64 having a helical groove shape is formed on the circular column part 62.

When the helical guide rail 64 is formed on the outer peripheral surface of the circular column part 62 by using a cutting tool (a flat end mill), the circular column part 62 is positioned with respect to the tool such that the central axis line of the tool and the central axis line of the circular column part 62 perpendicularly intersect with each other as shown by the left figure of FIG. 15(A). Then, in this state, the tool enters up to a predetermined groove depth. Thereafter, in order to form a helical groove shape, the action to rotate the circular column part 62 and to move the same with respect to the axial direction is performed in a state in which the tool has entered into the circular column part 62.

Points X1 and Y1 in FIG. 15(A) show respective contact points between a lower end part and an upper end part of the side wall surface of the guide rail 64 and the tool at the moment when the processing is performed at the position shown in FIG. 15(A). The figure on the right hand side in FIG. 15(A) is a view of the guide rail 64 viewed downwardly from the central axis line direction of the tool. When viewed from the direction in this figure, the points X1 and Y1 are at the same moving position. It is noted that in this figure, the points X1 and Y1 are shown to be slightly shifted from each other such that the two can be distinguished.

FIG. 15(B) shows a state in which the circular column part 62 rotates by 15° with respect to FIG. 15(A) and thus the processing has proceeded. The points X2 and Y2 in FIG. 15(B) are points corresponding to the above described points X1 and Y1 at the moment when the processing has been performed at the positions shown in FIG. 15(B). Thus, at the position of FIG. 15(B) where processing for the part of 15° has progressed, a difference in moving position occurs between the point X1 and the point Y1 when viewed from the direction shown by the right hand side figure of FIG. 15(B). Moreover, the circular column part 62 during processing moves in the axial direction as well. Therefore, when viewed from the direction shown by the right-hand side figure of FIG. 15(B), the point X1 of the inner diameter side and the point Y1 of the outer diameter side do not pass through the same position in the moving direction of the guide rail 64, and the point Y1 passes through an inner side region than the point X1 does. As a result, the side wall surface of the guide rail 64 comes to be inclined with respect to the groove bottom surface excepting sites where the central axis line of the tool and the central axis line of the circular column part 62 perpendicularly intersect with each other. It is noted that the higher the height of the side wall surface of the guide rail 64 is (that is, the deeper the groove of the guide rail 64 is), the larger the inclination of the side wall surface becomes; and similarly the steeper the inclination of the helical is, the larger the inclination of the side wall surface becomes.

Referring back to FIG. 14, description will be continued.

Because of the above described reason, when the guide rail 64 is viewed from the same direction as the pin position P2 at the pin position P1 which is a backward position in the moving direction of the projection part 58*c* in the guide rail 64 with respect to the pin position P2, the load bearing surface (side wall surface) 64*d* of the guide rail 64 is inclined toward the inside of the groove as shown by the groove cross section S1 in FIG. 14(C). Therefore, in this case, the projection part 58*c* and the load bearing surface 64*d* come into contact with each other only in the upper part of the load bearing surface 64*d* (becomes a point contact), similarly to the case shown in FIG. 12 described above. Also, when the guide rail 64 is viewed from the same direction as the pin position P2 at the pin position P3 which is a forward position in the moving direction of the projection part 58*c* in the guide rail 64 with respect to the pin position P2, the load bearing surface (side wall surface) 64*d* of the guide rail 64 is inclined toward the outside of the groove as shown by the groove cross section S3 in FIG. 14(C). Therefore, in this case, the projection part 58*c* and the load bearing surface 64*d* come into contact with each other only in the lower part of the load bearing surface 64*d* (become a point contact).

In contrast to this, according to the above described placement method of the present embodiment, the side surface of the projection part 58*c* and the load bearing surface 64*d* come into contact with each other (become a line contact) over the entire load bearing surface 64*d* as shown by the groove cross section S2 in FIG. 14(C). In this way, such increase in the contact area between the load bearing surface 64*d* and the projection part 58*c* allows favorable reduction of the contact pressure generated between the two as already described.

In the first embodiment, which has been described above, description is made by taking an example of the configuration in which the valve opening characteristics of the valve 18 change from the valve operating state to the valve stop state as the slide pin 58 to which the projection part 58*c* is fixed is relatively displaced with respect to the circular column part 62 whose position in the axial direction of the camshaft 12 is fixed, when the projection part 58*c* which is protruded by the actuator 66 is engaged with the guide rail 64. However, the variable valve operating apparatus to be addressed in the present invention is not limited to such a configuration and may, for example, have the following configuration. That is, an actuator having a moving element that functions as the projection part of the present invention is provided, and a member that integrally includes a circular column part to which a guide rail is fixed, and two kinds of cams, is attached to a camshaft so as to be movable in the axial direction. Then, it is configured such that the valve opening characteristics change as the above described member including the circular column part and two kinds of cams is relatively displaced with respect to the actuator (projection part) whose the position in the axial direction of the camshaft is restricted when the projection part and the guide rail are engaged with each other.

Further, in the above described first embodiment, description has been made taking an example of a configuration including the guide rail 64 which has a helical groove shape. However, the guide rail of the present invention does not need to be formed into a groove shape, provided that it has a helical wall part that is engageable with the projection part to change the valve opening characteristics of the valve 18.

Moreover, in the above described first embodiment, although an example in which the auxiliary cam 16 is configured to be a zero lift cam has been described, the auxiliary cam in the present invention is not limited to a zero lift cam. That is, it may be a cam having a nose part which makes it possible to obtain a smaller lift than the main cam 14. That is, the variable valve operating apparatus of the present invention is not limited to a type which changes over between the valve operating state and the valve stop state, and may be one that changes over the lift amount or the operating angle of the valve in two steps.

It is noted that in the above described first embodiment, the load bearing surface 64*d* of the guide rail 64 corresponds to the "helical wall part" in the above described first aspect of the present invention.

Second Embodiment

Next, referring to FIGS. 16 to 19, a second embodiment of the present invention will be described.

It is supposed that the variable valve operating apparatus of the present embodiment is configured in a similar manner as in the variable valve operating apparatus 10 of the above described first embodiment except for the points described below.

Figure 16:
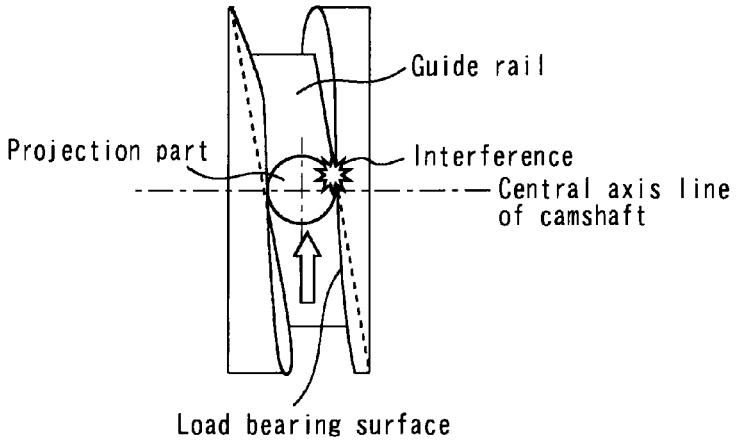
FIG. 16 is a view of the guide rail viewed from the direction of a straight line that perpendicularly intersects with the central axis line of the camshaft.

FIG. 16 is a view of the guide rail 64 viewed from the direction of a straight line that perpendicularly intersects with the central axis line of the camshaft 12. It is noted that in FIG. 16, from the view point of better understanding of the description, the inclination of the side wall surface of the guide rail 64 is notably represented.

In order to reduce the contact pressure generated between the projection part 58*c* and the load bearing surface 64*d*, it is desirable to increase the contact area between the two. For that purpose, it is desirable to expand the contact part between the two, such as from a point contact to a line contact. Further, to expand the contact part between the two, it is desirable that a broad contact with the projection part 58*c* can be secured from the bottom part to the upper part of the load bearing surface 64*d*.

As already described in the first embodiment, when the guide rail 64 is viewed from the direction of a straight line that perpendicularly intersects with the central axis line of the camshaft 12, the inclination of the side wall surface of the guide rail 64 increases as the distance from the central axis of the camshaft 12 increases (see the pin positions P1 and P3 in FIG. 14). Therefore, as with the above described first embodiment, in a case in which the projection part 58*c* is placed with respect to the guide rail 64 such that the central axis line of the camshaft 12 perpendicularly intersects with the central axis line of the projection part 58*c*, if a projection part which is formed into a columnar shape which has the same diameter at the base end part and the distal end part thereof in the same manner with the projection part 58*c*, the distal end of the projection part becomes more likely to interfere with the load bearing surface 64*d* at sites on the forward side in its moving direction as shown in FIG. 16. As a result, it becomes difficult to secure sufficient contact with the projection part 58*c* in a region from the bottom part to the upper part of the load bearing surface 64*d*.

Figure 17:
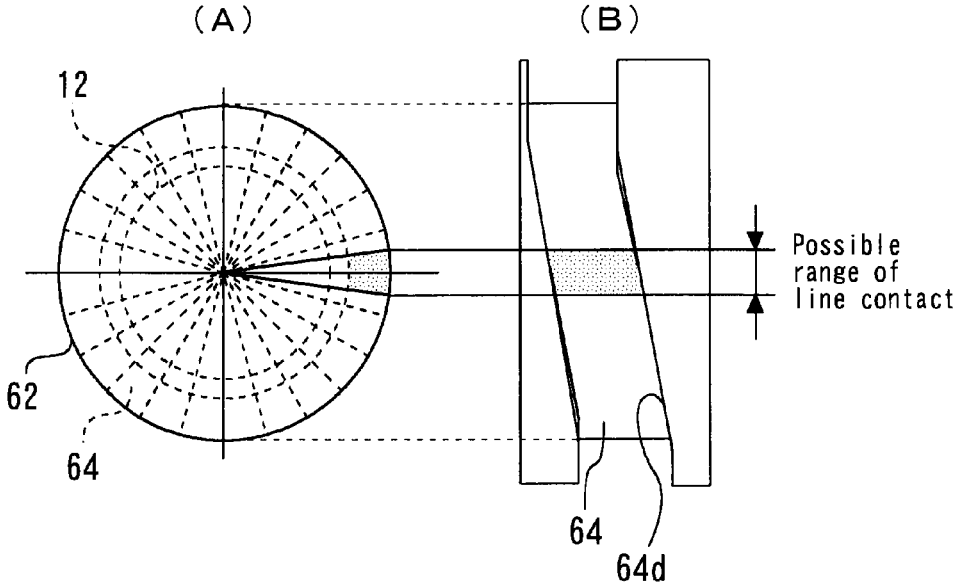
FIG. 17 is a diagram to show the range within which a line contact with the side surface of the projection part of the slide pin is possible in the guide rail having a helical groove shape.

FIG. 17 is a diagram to show the range within which a line contact with the side surface of the projection part of the slide pin is possible in the guide rail 64 having a helical groove shape. It is noted that while, strictly speaking, the contact between the projection part and the load bearing surface 64*d* becomes, not a line contact, but a contact in a strip-shape region having a certain width, it is expressed herein as a line contact because it is aimed at ensuring a contact length in the region from the bottom part to the upper part of the load bearing surface 64*d*.

When the projection part 58*c* is placed with respect to the guide rail 64 such that the central axis line of the camshaft 12 and the central axis line of the projection part 58*c* intersect perpendicularly with each other, the range in which the load bearing surface 64*d* is perpendicular to the groove bottom surface (that is, the range in which the side face of the projection part is in parallel with the load bearing surface 64*d*) is limited by the presence of the inclination of the side wall surface of the guide rail 64. Thus, such a range where a line contact becomes possible is a range that spreads outwardly from the center of the camshaft 12 (the circular column part 62) into a fan shape as shown in FIG. 17(A). The reason why the range of the load bearing surface 64*d* in which it is perpendicular to the groove bottom surface becomes a fan shape in this way is that the processing of the guide rail 64 is performed by rotating the circular column part 62 in a state that the circular column part 62 is positioned with respect to the tool such that the central axis line of the tool and the central axis line of the circular column part 62 perpendicularly intersect with each other as already described.

Therefore, in order to avoid a local interference between the projection part and the load bearing surface 64*d* as shown in FIG. 16, thereby securing a large contact area between the two, it is effective to configure such that the projection part stays within the above described range of fan shape when viewed from the axial direction of the camshaft 12.

Figure 18:
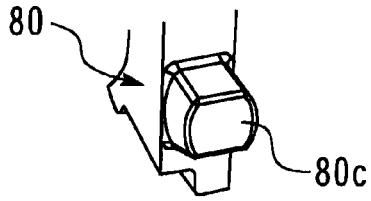
FIG. 18 is a diagram to illustrate the shape of a projection part of a slide pin in a second embodiment of the present invention.
Figure 18:
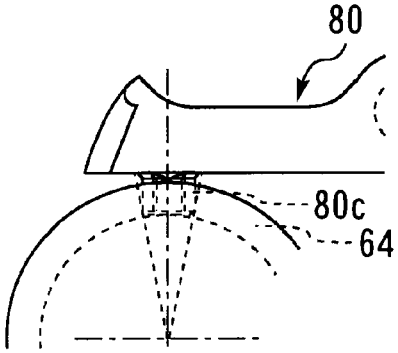

FIG. 18 is a diagram to illustrate the shape of a projection part 80*c* of a slide pin 80 in the second embodiment of the present invention.

In the present embodiment as well, the placement of the projection part 80*c* with respect to the guide rail 64 is determined such that the central axis line of the camshaft 12 and the central axis line of the projection part 80*c* perpendicularly intersect with each other in a state in which the projection part 80*c* is protruded toward the guide rail 64 by the actuator 66.

In addition, in the present embodiment, as shown in FIG. 18(B), the projection part 80*c* is formed such that it is narrowed down toward the shaft center of the camshaft 12 when viewed from the axial direction of the camshaft 12 in a state in which the projection part 80*c* is protruded toward the guide rail 64 by the actuator 66. To be more specific, the projection part 80*c* is tapered to be thinner toward the distal end side when viewed from the axial direction of the camshaft 12. This makes it possible to form the projection part 80*c* so as to stay within the above described range of fan shape when viewed from the axial direction of the camshaft 12.

Figure 19:
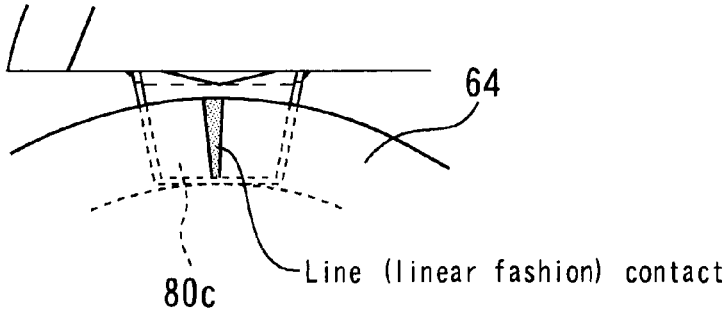
FIG. 19 is a diagram to represent the contact state between a projection part 80*c* and a load bearing surface in the second embodiment of the present invention.

FIG. 19 is a diagram to represent the contact state between the projection part 80*c* and the load bearing surface 64 in the second embodiment of the present invention.

As a result of providing the projection part 80*c* formed as described above, a local contact with load bearing surface 64*d* is avoided, thus making it possible to secure a contact range between the projection part 80*c* and the load bearing surface 64*d* widely in a linear fashion from the bottom part to the upper part of the load bearing surface 64*d* as shown in FIG. 19. In this way, according to the configuration of the present embodiment, the contact area between the projection part 80*c* and the load bearing surface 64*d* increases, thereby making it possible to effectively reduce the contact pressure generated between the two.

By the way, the above described second embodiment is configured such that the projection part 80*c* is tapered to be thinner toward the distal end side when viewed from the axial direction of the camshaft 12. However, the form of narrowing down the projection part is not limited to the one of the above described shape, and the projection part of the present invention may be in any form provided that it is narrowed down toward the shaft center of the camshaft when viewed from the axial direction of the camshaft in a state of being protruded toward the guide rail by the actuator. That is, the projection part may have, for example, a shape that is narrowed down in a curved line not in a straight line when viewed from the axial direction of the camshaft, or may have a shape which is narrowed down to be thinner in a stepwise manner as approaching the distal end side. Further, more broadly grasping the idea of the shape of the projection part in the present invention, the projection part may have any form provided that its width at the distal end part is smaller than the width at the base end part, and the width in an intermediate part is not larger than that at the based end part when viewed from the axial direction of the camshaft. Forming the projection part in such a way is advantageous in keeping the projection part within the range of a fan shape in which the line contact shown in FIG. 17 is possible, compared to a projection part formed into a columnar shape.

[Other Configuration to Reduce Contact Load Generated Between Projection Part and Load Bearing Surface]

Next, referring to FIGS. 20 to 25, a configuration to reduce the contact load that is generated between the projection part of the slide pin and the load bearing surface of the guide rail will be described. It is noted that while such configuration is applicable in an additive manner to either of the configuration of the first or second embodiment described above, herein, an example in which such configuration is applied to the configuration of the first embodiment will be described.

Figure 20:
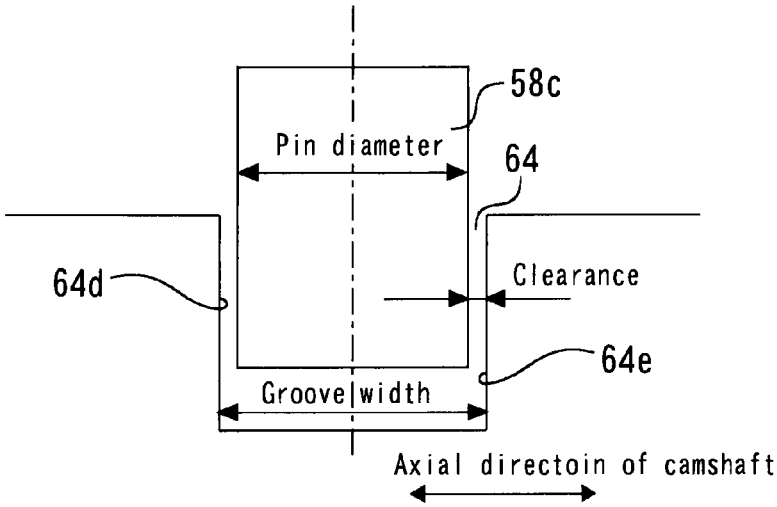
FIG. 20 is a diagram to illustrate a general setup of the clearance between the guide rail and the projection part when the projection part is protruded toward the guide rail.

FIG. 20 is a diagram to illustrate a general setup of the clearance between the guide rail 64 and the projection part 58*c* when the projection part 58*c* is protruded toward the guide rail 64.

In a state in which the projection part 58*c* is protruded toward the guide rail in a straight line section of the guide rail 64, the position of the projection part 58*c* in the axial direction of the camshaft 12 with respect to the guide rail 64, as shown in FIG. 20, generally set such that the center of the projection part 58*c* coincides with the center of the groove width of the guide rail 64 (that is, left and right clearances are equaled). According to such setup, even if an assembly error takes place, it is possible to minimize the probability that the projection part 58*c* and the side wall surface of the guide rail 64 interfere with each other in the straight line section. Moreover, if the projection part 58*c* is positioned too close to the load bearing surface 64*d* side of the guide rail 64 in the straight line section, there is possibility that the projection part 58*c* and the groove upper surface of the guide rail 64 interfere with each other, resulting in that the projection part 58*c* does not enter into the guide rail 64. On the contrary, when the projection part 58*c* is positioned too close to an opposing surface 64*e* side of the guide rail 64, even if the projection part 58*c* does not enter into the guide rail 64 in the straight line section, the projection part 58*c* can enter into the guide rail 64 in the following inclined section (slide section). Therefore, in the past, there was tendency that the projection part is assembled by being put closer to the opposing surface side of the guide rail so as to prevent misengagement between the projection part and the guide rail.

Figure 21:
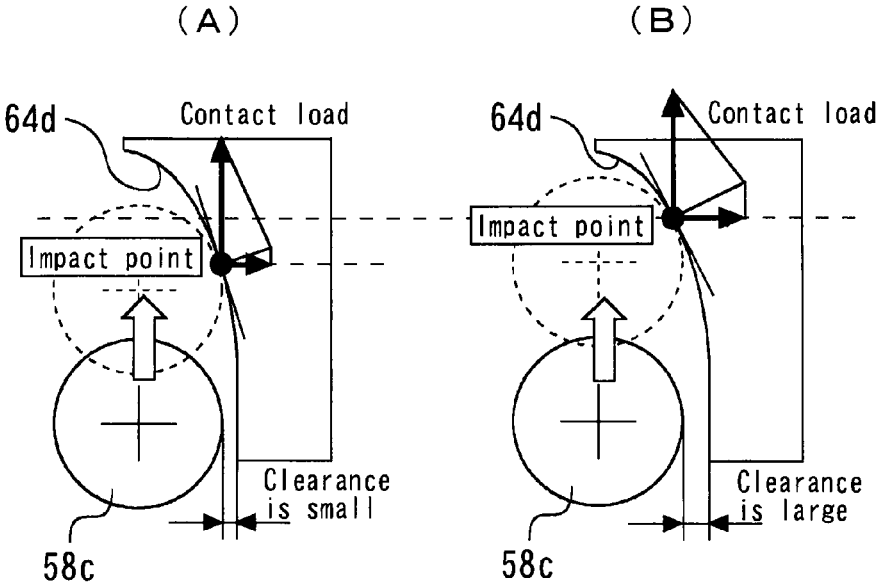
FIG. 21 is a diagram to illustrate the change of contact load according to the clearance between the projection part and the wall part of the load bearing surface side in the straight line section of the guide rail.

FIG. 21 is a diagram to illustrate the change of contact load according to the clearance between the projection part 58*c* and the wall part of the load bearing surface 64*d* side in the straight line section of the guide rail 64. To be more specific, FIG. 21(A) shows an example in which the clearance between the projection part 58*c* and the wall part of the load bearing surface 64*d* side is small, and FIG. 21(B) shows an example in which the clearance between the projection part 58*c* and the wall part of the load bearing surface 64*d* side is large.

As shown in FIG. 21(A), when the above described clearance is small, the impact point between the projection part 58*c* and the load bearing surface 64*d* is positioned near the straight line section of the guide rail 64. Since at such a position, the wall part of the guide rail 64 slightly inclines with respect to the straight line section, the angle of the contact between the projection part 58*c* and the load bearing surface 64*d* decreases. Thereby, the repulsive force that the projection part 58*c* receives from the load bearing surface 64*d* decreases and the contact load generated between the two decreases. On the other hand, as shown in FIG. 21(B), when the above described clearance is large, the impact point between the projection part 58*c* and the load bearing surface 64*d* is positioned apart from the straight line section of the guide rail 64 compared to FIG. 21(A). In such a position, the angle at which the projection part 58*c* and the load bearing surface 64*d* come into contact increases. Thereby, the repulsive force that the projection part 58*c* receives from the load bearing surface 64*d* increases and the contact load generated between the two increases.

As described so far, configuring the above described clearance to be small in the straight line section of the guide rail 64 is effective in reducing the contact load between the projection part 58*c* and the load bearing surface 64*d*. Accordingly, such a configuration may be provided which presses (to guide) the projection part 58*c* against the wall part of the load bearing surface 64*d* side by utilizing the straight line section of the guide rail 64 as with the four types of examples shown in FIGS. 22 to 25.

Figure 22:
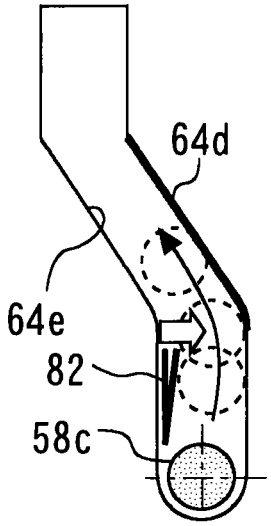
FIG. 22 is a diagram to illustrate a method of guiding the projection part by using a spring plate.

FIG. 22 is a diagram to illustrate a method of guiding the projection part 58*c* by using a spring plate 82.

The configuration shown in FIG. 22 is provided with the spring plate 82 at a site on the opposing surface 64*e* side in the straight line section of the guide rail 64. According to such a configuration, it is possible to guide the projection part 58*c* to the load bearing surface 64*d* side by utilizing the repulsive force of spring. This makes it possible to decrease the above described clearance, thereby steadily reducing the contact load generated between the projection part 58*c* and the load bearing surface 64*d*.

Figure 23:
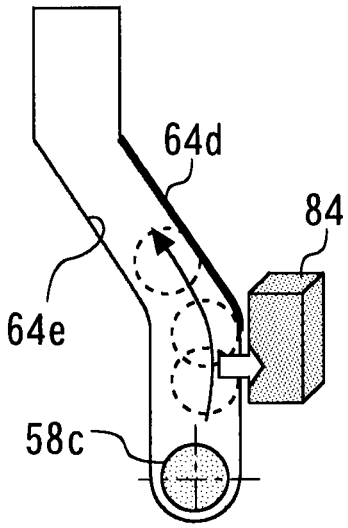
FIG. 23 is a diagram to illustrate a method of guiding the projection part by using a permanent magnet.

FIG. 23 is a diagram to illustrate a method of guiding the projection part 58*c* by using a permanent magnet 84.

The configuration shown in FIG. 23 shows that the permanent magnet 84 is provided at a site on the load bearing surface 64*d* side in the straight line section of the guide rail 64. According to such configuration, it is possible to guide the projection part 58*c* to the load bearing surface 64*d* side by utilizing the magnetic force exerted by the permanent magnet 84.

Figure 24:
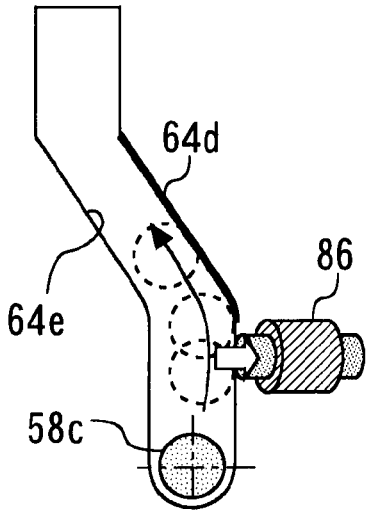
FIG. 24 is a diagram to illustrate a method of guiding the projection part by using an electric magnet.

FIG. 24 is a diagram to illustrate a method of guiding the projection part 58*c* by using an electric magnet 86.

The configuration shown in FIG. 24 is provided with the electric magnet 86 at a site on the load bearing surface 64*d* side in the straight line section of the guide rail 64. According to such a configuration, by energizing the electric magnet 86 in synchronous with the action of protruding the projection part 58*c* toward the guide rail 64 by the actuator 66, it is possible to guide the projection part 58*c* toward the load bearing surface 64*d* side by utilizing the magnetic force exerted by the electric magnet 86.

Figure 25:
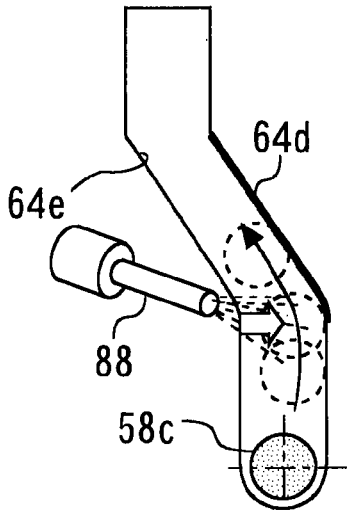
FIG. 25 is a diagram to illustrate a method of guiding the projection part by using an oil injection nozzle.

FIG. 25 is a diagram to illustrate a method of guiding the projection part 58*c* by using an oil injection nozzle 88.

The configuration shown in FIG. 25 is provided with the oil injection nozzle 88 that injects engine oil to a site on the opposing surface 64*e* side in the straight line section of the guide rail 64. According to such a configuration, by forming an oil path such that the engine oil that lubricates each part of the internal combustion engine is supplied to the oil injection nozzle 88 as well, it is possible to guide the projection part 58*c* to the load bearing surface 64*d* side by utilizing the discharge force of the oil injected from the oil injection nozzle 88.

Third Embodiment

Next, referring to FIGS. 26 to 29, a third embodiment of the present invention will be described.

It is supposed that the variable valve operating apparatus of the present embodiment is configured such that a configuration to be described below is further added to the variable valve operating apparatus 10 including the configuration shown in FIGS. 18 and 19 in the above described second embodiment.

Figure 26:
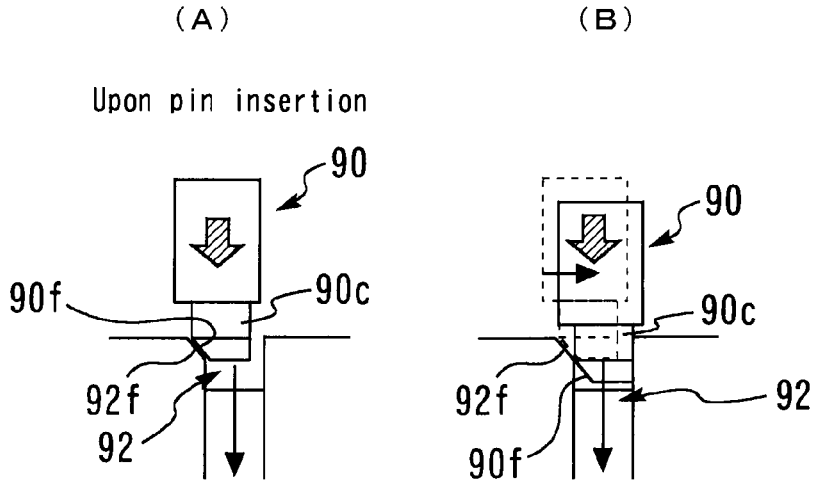
FIG. 26 is a diagram to illustrate the shape of guide surfaces provided on a projection part of a slide pin and the groove upper part of a guide rail in a third embodiment of the present invention, respectively.

FIG. 26 is a diagram to illustrate the shape of guide surfaces 90*f* and 92*f* provided on a projection part 90*c* of a slide pin 90 and the groove upper part of a guide rail 92 in the third embodiment of the present invention, respectively. To be more specific, FIG. 26 is a diagram of the distal end part of the projection part 90*c* and the groove upper part of the guide rail 92 viewed from the normal line direction of a virtual plane including the intersection line between the central axis line of the projection part 90*c* and the central axis line of the camshaft 12 in a state in which the projection part 90*c* of the slide pin 90 is protruded toward the guide rail 92 by the actuator 66.

As shown in FIG. 26, the distal end part of the projection part 90*c* and the groove upper part of the guide rail 92 are provided with guide surfaces 90*f* and 92*f* that guide the distal end part of the projection part 90*c* to be inserted into the guide rail 92, respectively. Describing more specifically, these guide surfaces 90*f* and 92*f* are formed as a surface inclined downward of the load bearing surface (the helical wall part) 92*d*, when viewing the distal end part of the projection part 90*c* and the groove upper part of (the load bearing surface 92*d* of) the guide rail 92 from the above described normal line direction.

As already described with reference to FIGS. 20 and 21, when the clearance between the projection part 90*c* and the side wall surface of the guide rail 92 upon insertion into the guide rail 92 is large, the contact load generated between the two increases. FIG. 26(A) shows a state in which the projection part 90*c* and the guide rail 92 are in contact with each other when the projection part 90*c* is inserted into the guide rail 92. Such a contact state occurs due to a positional deviation in the axial direction of the camshaft 12 between the projection part 90*c* and the guide rail 92.

In the present embodiment, as a result of providing the above described guide surfaces 90*f* and 92*f*, even if the above described positional deviation occurs as shown in FIG. 26(A), the distal end part of the projection part 90*c* is guided by these guide surfaces 90*f* and 92*f* so as to be fitted into the guide rail 92. This corrects the above described positional deviation. Thereby, it is possible to ensure the reliability of inserting the projection part 90*c* into the guide rail 92 while reducing the above described clearance between the projection part 90*c* and the guide rail 92.

Figure 27:
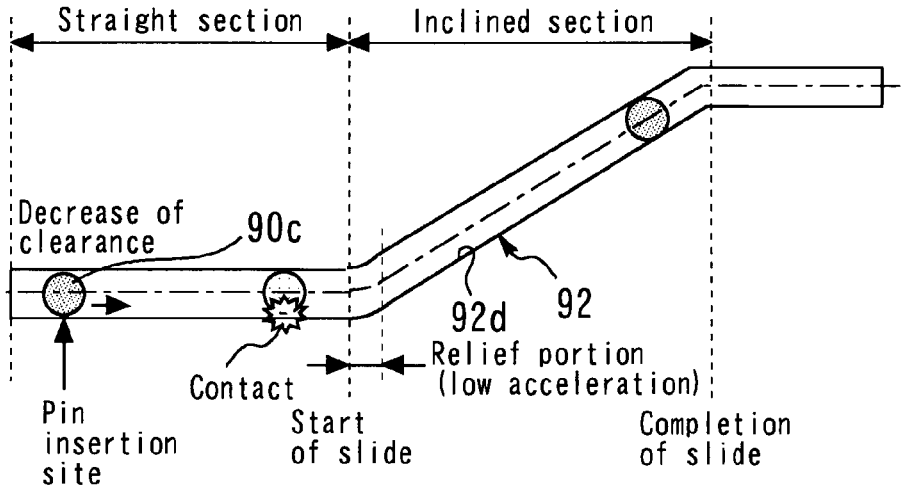
FIG. 27 is a diagram to illustrate the effect of providing the guide surfaces in the projection part and the guide rail.

FIG. 27 is a diagram to illustrate the effect of providing the above described guide surfaces 90*f* and 92*f* in the projection part 90*c* and the guide rail 92.

Providing the above described guide surfaces 90*f* and 92*f* enables the insertion (engagement) of the projection part 90*c* into the guide rail 92 even without the above described clearance. Accordingly, the placement of the projection part 90*c* with respect to the guide rail 92 may be determined such that the insertion of the projection part 90*c* into the guide rail 92 is performed by always being guided by the guide surfaces 90*f* and 92*f*, without providing the above described clearance. This makes it possible to configure such that the projection part 90*c* comes into contact with the side wall surface (load bearing surface 92*d*) of the guide rail 92 in the straight line section as shown in FIG. 27, before the projection part 90*c* reaches the inclined section of the guide rail 92. As a result, the acceleration (≅impact load) at the time of contact can be reduced compared to a case in which the projection part 90*c* collides with the load bearing surface 92*d* of the guide rail 92 in the inclined section.

Moreover, by determining the placement of the projection part 90*c* with respect to the guide rail 92 as described above, it is possible to shorten a relief portion (a site having a gentle inclination) which is provided to reduce the acceleration when the projection part 90*c* comes into contact with the load bearing surface 92*d*. When the length of the inclined section is constant, and the stroke amount of the projection part 90*c* guided by the guide rail 92 is constant, such shortening of the relief portion makes it possible to loosen the inclination of the entire inclined section, thereby reducing the acceleration (≅impact load) which acts on the projection part 90*c* when it passes through the inclined section.

Figure 28:
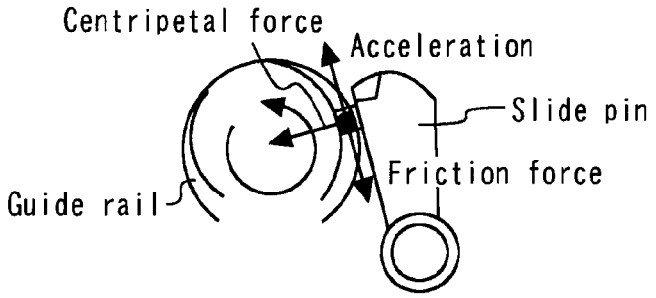
FIG. 28 is a diagram to illustrate a centripetal force that is produced at the slide pin upon contact between the projection part and the side wall surface of the guide rail.

FIG. 28 is a diagram to illustrate a centripetal force that is produced at the slide pin upon contact between the projection part and the side wall surface of the guide rail. It is noted that the description regarding FIG. 28 addresses the configuration without the guide surfaces 90*f* and 92*f* of the present embodiment.

When the side wall surface of the guide rail and the projection part of the slide pin come into contact with each other, a friction force acts between the above described side wall surface which rotates around the shaft center of the camshaft and the projection part. As a result, a force (centripetal force) to pull the projection part to the center of the camshaft acts on the slide pin which is provided with the projection part. As a result, even though not being pressed by the actuator, there may be a case in which the project part is held being engaged with the guide rail. If that is the case, when the projection part is brought into contact with the side wall surface of the guide rail due to vibration or the like generated by the internal combustion engine 1 under a condition where no request for stopping the valve is issued, the projection part and the guide rail are brought into engagement with each other by the action of the above described centripetal force, thereby the slide pin being possibly displaced in the axial direction so as to come into the valve stop state.

Figure 29:
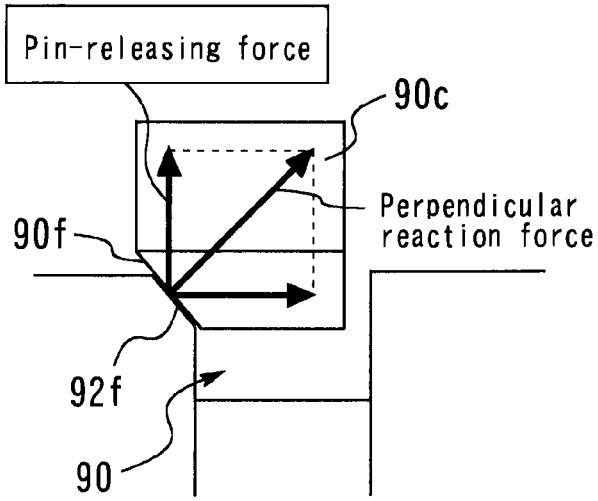
FIG. 29 is a diagram to represent the force that acts on the guide surface of the projection part when the guide surface of the projection part comes into contact with the guide surface of the guide rail.

FIG. 29 is a diagram to represent the force that acts on the guide surface 90*f* of the projection part 90*c* when the guide surface 90*f* of the projection part 90*c* comes into contact with the guide surface 92*f* of the guide rail 92.

In the configuration of the present embodiment, as shown in FIG. 29, when the guide surface 90*f* of the projection part 90*c* is pressed against the guide surface 92*f* of the guide rail 92, the guide surface 90*f* of the projection part 90*c* is subjected to a perpendicular reaction force from the guide surface 92*f*. Thus, when such a perpendicular reaction force acts, a biasing force (hereafter, referred to as a "pin-releasing biasing force") that causes the slide pin 90 (the projection part 90*c*) to be released out of the guide rail 92 acts on the guide surface 90*f* of the projection part 90*c*.

According to the configuration including the above described guide surfaces 90*f* and 92*f*, even when the projection part 90*c* is brought into contact with the guide rail 92 by, for example, vibration generated by the internal combustion engine 1, it is possible to restrict the insertion of the projection part 90*c* into the guide rail 92 by the above described pin-releasing biasing force that acts on the guide surface 90*f* of the projection part 90*c*. This makes it possible to prevent the occurrence of an inadvertent valve stop state due to the effect of the above described centripetal force during operation of the internal combustion engine 1.

Meanwhile, the above described third embodiment is configured such that guide surfaces 90*f* and 92*f* are provided in both of the distal end part of the projection part 90*c* of the slide pin 90 and the groove upper part of the guide rail 92. However, the present invention may be configured, without being limited to such a configuration, such that a guide surface as described above is provided only in either one of the distal end part of the projection part and the upper part of the helical wall part of the guide rail.

[Another Configuration to Reduce Contact Load Generated Between Projection Part and Load Bearing Surface]

Moreover, in the above described third embodiment, in order to reduce the contact load (impact load) by reducing the clearance between the projection part 90*c* and the side wall surface of the guide rail 92, the placement of the projection part 90*c* with respect to the guide rail 92 is determined such that the projection part 90*c* is inserted into the guide rail 92 while being guided by the above described guide surfaces 90*f* and 92*f*. However, in place of the above described configuration, a configuration as shown below in FIG. 30 may be adopted.

Figure 30:
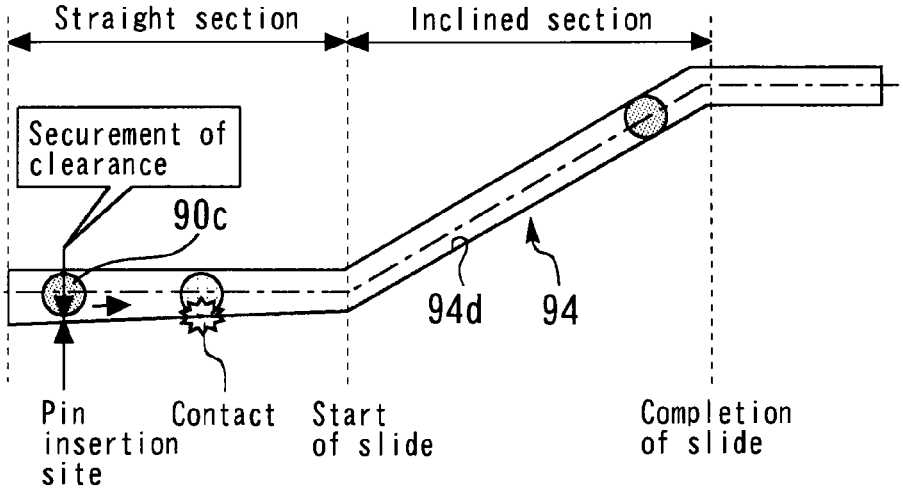
FIG. 30 is a diagram to illustrate another configuration to enable the reduction of the contact load generated between the projection part of the slide pin and a load bearing surface of the guide rail.

FIG. 30 is a diagram to illustrate another configuration to enable the reduction of the contact load generated between the projection part 90*c* of the slide pin 90 and the load bearing surface 94*d* of the guide rail 94.

The straight line section in the guide rail 94 shown in FIG. 30 is configured such that the groove width is gradually narrowed as the position approaches from the insertion site of the projection part 90*c* (pin insertion site) to the inclined section. According to such a configuration, it is possible to sufficiently maintain the above described clearance at the pin insertion site, thereby ensuring the reliability of inserting the projection part 90*c* into the guide rail 94. Moreover, according to the above described configuration, the projection part 90*c* and the load bearing surface 94*d* are brought into contact in the straight line section which is a section where the acceleration when the projection part 90*c* contacts the load bearing surface 94*d* is small. This enables the reduction of the above described contact load compared to the case where the projection part 90*c* collides with the load bearing surface 94*d* in the inclined section.

[Other Configurations to Obtain Pin-Releasing Biasing Force]

Further, the above described third embodiment is configured to obtain the above described pin-releasing biasing force by utilizing the above described guide surfaces 90*f* and 92*f*. However, such a configuration to obtain the pin-releasing biasing force is not limited to the above described one, and may be, for example, a configuration as shown in FIGS. 31 to 33 below.

Figure 31:
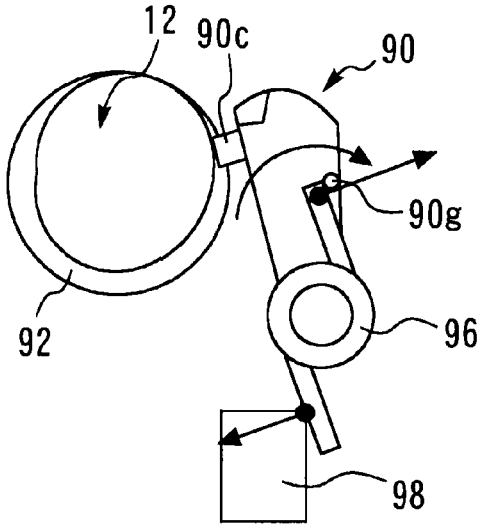
FIG. 31 is a diagram to illustrate a method of adding a pin-releasing biasing force using a torsion coil spring.

FIG. 31 is a diagram to illustrate a method of adding a pin-releasing biasing force using a torsion coil spring 96.

The configuration shown in FIG. 31 is provided with a torsion coil spring 96 which is wound around the rotational axis of the slide pin 90. One end of the torsion coil spring 96 is locked to a latch part 90*g* of the slide pin 90, and the other end thereof is locked to a supporting part 98 included in a stationary member of the internal combustion engine 1, such as a cam carrier or the like. According to such a configuration, it is possible to obtain the above described pin-releasing biasing force by utilizing the repulsive force of the torsion coil spring 96.

Figure 32:
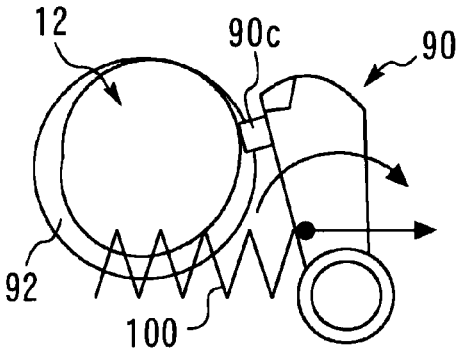
FIG. 32 is a diagram to illustrate a method of adding a pin-releasing biasing force utilizing a compression coil spring.
Figure 33:
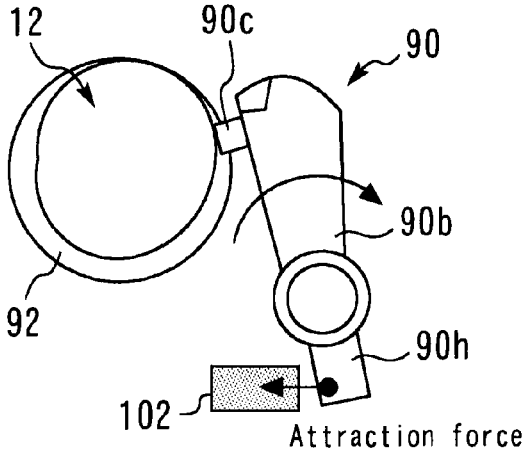
FIG. 33 is a diagram to illustrate a method of adding a pin-releasing biasing force using a permanent magnet.

FIG. 32 is a diagram to illustrate a method of adding a pin-releasing biasing force utilizing a compression coil spring 100.

The configuration shown in FIG. 32 is provided with a compression coil spring 100 of which one end is locked to the slide pin 90, and the other end is locked to a support part which is not shown. According to such a configuration, it is possible to obtain the above described pin-releasing biasing force by utilizing the repulsive force of the compression coil spring 100.

FIG. 33 is a diagram to illustrate a method of adding a pin-releasing biasing force using a permanent magnet 102.

The configuration shown in FIG. 33 includes an arm part 90*h* which extends to the opposite side of an arm part 90*b* with respect to the rotational axis of the slide pin 90, and a permanent magnet 102 at a position close to the arm part 90*h*. According to such a configuration, it is possible to obtain the above described pin-releasing biasing force by utilizing the attraction force of the permanent magnet 102. It is noted that configuration may be such that a tensile force of a tensile spring (not shown) is used in place of the attraction force of the permanent magnet 102.

The invention claimed is:

1. A variable valve operating apparatus for an internal combustion engine, comprising:

a variable mechanism which is placed between a cam and a valve, and changes valve opening characteristics of the valve; and a changeover mechanism which changes over operational states of the variable mechanism, wherein the changeover mechanism includes:

a guide rail which is provided in an outer peripheral surface of a camshaft including the cam, and is provided with a helical wall part;

a projection part which is disengageably placed in the helical wall part; and an actuator which is capable of protruding the projection part toward the guide rail such that the projection part is engaged with the helical wall part, wherein the changeover mechanism is adapted to change over operation states of the variable mechanism in association with a relative displacement between the projection part and the helical wall part that takes place during engagement between the projection part and the helical wall part, wherein a placement of the projection part with respect to the helical wall part is determined such that a central axis line of the projection part and a central axis line of the camshaft perpendicularly intersect with each other in a state in which the projection part is protruded toward the guide rail by the actuator, and wherein the projection part is tapered to be thinner toward a distal end side when viewed from an axial direction of the camshaft.

2. The variable valve operating apparatus for an internal combustion engine according to claim 1, wherein a guide surface that guides the distal end side of the projection part which is inserted to the helical wall part is formed in at least one of the distal end side of the projection part and an upper part of the helical wall part.

3. The variable valve operating apparatus for an internal combustion engine according to claim 2, wherein the guide surface is a surface inclined downward of the helical wall part when viewing the distal end part of the projection part and the upper part of the helical wall part from a normal line direction of a virtual plane to which both the central lines of the camshaft and the projecting part are both parallel in the state of being protruded toward the guide rail by the actuator.

* * * * *